US006773135B1

(12) United States Patent
Packer

(10) Patent No.: US 6,773,135 B1
(45) Date of Patent: Aug. 10, 2004

(54) LUMINAIRES HAVING SHAPED REFLECTIVE STRUCTURES FOR ILLUMINATING VERTICAL SURFACES SUCH AS BILLBOARDS AND THE LIKE

(75) Inventor: Michael Packer, Granville, OH (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 10/113,494

(22) Filed: Mar. 29, 2002

Related U.S. Application Data

(63) Continuation-in-part of application No. 09/538,671, filed on Mar. 30, 2000.

(51) Int. Cl.[7] ..... F21V 7/00

(52) U.S. Cl. ..... 362/145; 362/812; 362/308; 362/223; 40/541

(58) Field of Search ..... 362/145, 812, 362/308, 223; 40/541, 545, 557, 558, 560, 559

(56) References Cited

U.S. PATENT DOCUMENTS 4,954,935 A * 9/1990 Hammond et al. ..... 362/245
5,664,878 A * 9/1997 Subisak et al. ..... 362/290
5,938,317 A * 8/1999 Thornton ..... 362/290

* cited by examiner

*Primary Examiner*—Stephen Husar
*Assistant Examiner*—Anabel Ton
(74) *Attorney, Agent, or Firm*—Kenneth E. Darnell

(57) ABSTRACT

Lighting fixtures for illuminating vertical surfaces of predetermined dimensions such as billboards or similar signs, the invention in several embodiments takes the form of primary reflector structures capable of directing light from a light source disposed within each of said fixtures either directly to the vertical surface or to refractive structures located on the fixtures for redirection of light to the vertical surface for even illumination of said surface with minimal light pollution from "spill" light. The primary reflector structures of the invention are curvilinear in conformation and extend from above a light source to a location between the source and the vertical surface, the reflector structures being smoothly contoured or formed into a plurality of reflective segments. The primary reflector structures are preferably complemented by side reflectors of either flat, curved or faceted conformation that act to direct incident light directly onto the vertical surface or to refractive structures for redirection onto the vertical surface. Reflector assemblies configured according to the invention from any one of the primary reflectors either singly or in combination with said side reflectors can be preferably mounted within a housing for movement within said housing to more efficiently illuminate vertical surfaces of differing dimensions. The reflector assemblies of the invention are mounted within weather-tight housings, the refractive structures conveniently being disposed on or formed integrally with a transparent glass or plastic cover that completes the housing and which are located between the light source and the vertical surface to be illuminated. Efficiencies occasioned by the present fixtures permit illumination of billboards and similar signs of standard dimensions with but three of the fixtures and with full and even illumination with minimal light spillage, a capability approached previously with no fewer than four fixtures.

46 Claims, 15 Drawing Sheets

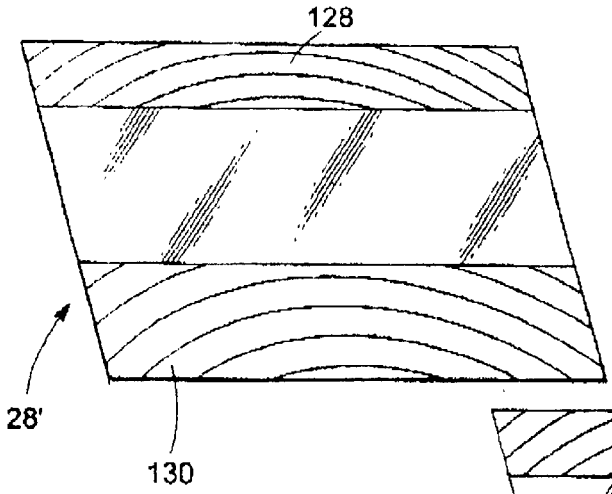
Fig. 11
Fig. 12
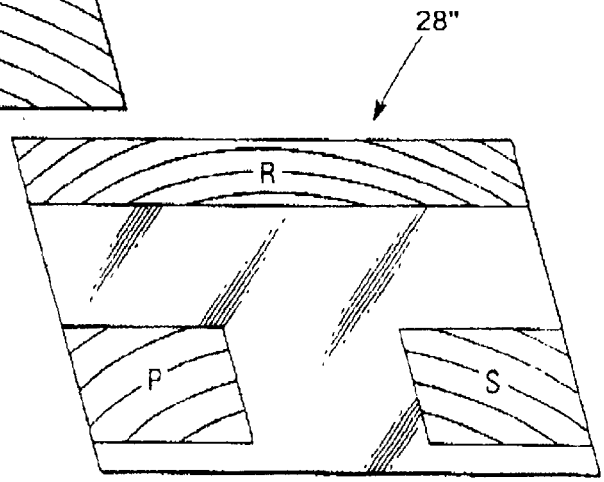
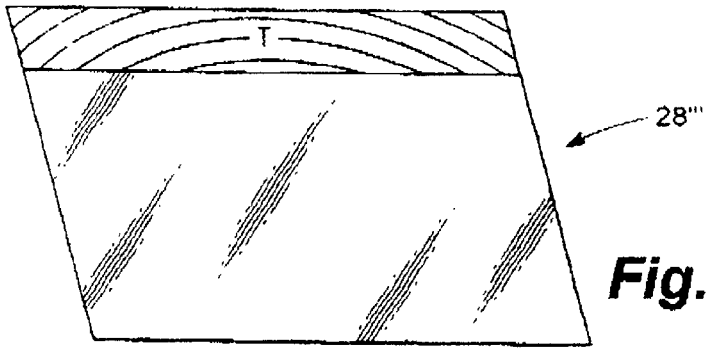
Fig. 13
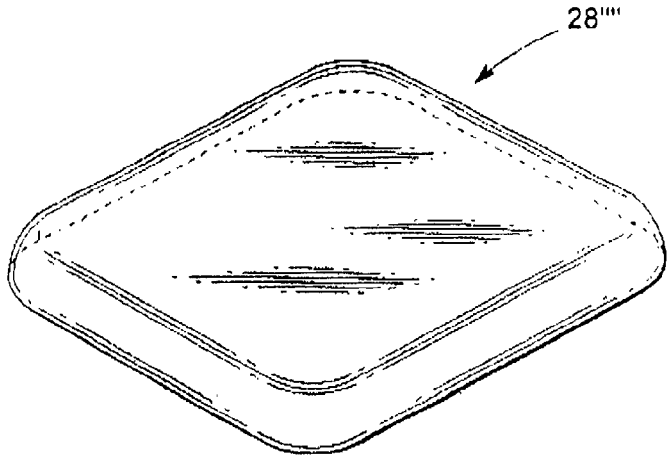
Fig. 14

LUMINAIRES HAVING SHAPED REFLECTIVE STRUCTURES FOR ILLUMINATING VERTICAL SURFACES SUCH AS BILLBOARDS AND THE LIKE

CROSS-REFERENCE TO RELATED APPLICATION

This application is a continuation-in-part of U.S. patent application Ser. No. 09/538,671, filed Mar. 30, 2000.

BACKGROUND OF THE INVENTION

1. Field of the Invention

The invention relates generally to luminaires intended for illumination of billboards, outdoor signs and similar vertical surfaces and particularly to luminaires of increased efficiency capable of superior lighting intensities and uniform illumination with reduced light "spillage".

2. Description of the Prior Art

Luminaires capable of illuminating vertical surfaces such as billboards and similar signs occupy a particular niche in the lighting field. Luminaires of this kind must operate in a harsh environment and be effectively impervious to the elements including rain, wind and heat. Prior luminaires developed for illumination of outdoor signs and the like have addressed the requirement that an illumination level of an intensity sufficient to allow the sign being illuminated to be viewed with comprehension from varying distances must be provided. Prior luminaires have also addressed a second requirement that such signs be illuminated to desired levels on various portions thereof to provide a desirable impression of uniformity. Prior luminaires have addressed these two requirements as fully as technology existing at the time permitted. However, as energy conservation considerations have increased in recent times, a further requirement of such luminaires has been to direct as much light as possible of the generated light onto an outdoor sign so that a maximum amount of the generated light is actually used, full utilization of the generated light typically permitting lessened light generation for a given situation with a resultant conservation of energy. In the present marketplace, energy conservation must not result in a reduction in lighting intensity and uniformity. Relatively more recent requirements relating to light "pollution" caused in part by light generated by luminaires that illuminate outdoor signs and the like have resulted in the necessity for the light generated by such luminaires be directed to the greatest degree possible onto the sign or billboard that is to be illuminated rather than "spill" about edges of such an outdoor sign, thereby producing stray light that accomplishes no function and acts to obscure the night sky. Light from such luminaires that is not focused onto the billboard or similar sign produces glare and clutter and effectively wastes energy through such inefficiency that the cost of such waste is estimated to exceed as much as one billion dollars on an annual basis. Spill light of this nature can negatively impact tasks performed near the location of an outdoor sign while contributing to "sky glow" and degrading the nocturnal environment so as to affect the quality of life in rural communities in particular as well as having a negative impact on business and recreational activities.

Luminaires employed for the illumination of outdoor signs and the like have existed for at least the better part of a century as is evidenced by existing United States patents disclosing luminaires for this very purpose. Ennever, in U.S. Pat. No. 2,746,187, describes a system for illumination of an outdoor display such as a billboard or similar outdoor sign, this patent describing luminaires mounted along an upper edge of a billboard and which cast light directly down onto the billboard through direct illumination as well as through reflection from a reflective structure surmounting a light source. Luminaires of the time of Ennever did not produce uniform light intensities over the full surface of a sign and were not energy efficient. In U.S. Pat. No. 3,647,148, Wince discloses luminaire structures having both reflective surfaces and refractive structures configured to direct light onto a particular objective as well as for general illumination. The luminaires disclosed by Wince were not particularly intended for illumination of vertical surfaces. However, the Wince patent provides a disclosure of the use of reflective surfaces and refractive structures for illumination. Odle et al, in U.S. Pat. No. 4,037,341, disclose luminaires intended for illumination of outdoor signs and the like having vertical surfaces intended to be illuminated. By the time of Odle et al, outdoor sign illumination had progressed to the point where a plurality of luminaires mounted in spaced relation to each other and spaced from the sign face to be illuminated were disposed in front of the sign and in proximity to a lower edge of the sign, light generated by the luminaires being directed at angles generally upwardly from said luminaires as opposed to the downward illumination provided by Ennever et al as mentioned above. The patent to Odle et al illustrates an intent to evenly illuminate an outdoor sign with an appropriate intensity and to produce positive side edge cut-off, that is, to minimize light passing from the luminaire and past edges of the sign, the energy generated to produce light not incident on the sign being wasted. Odle et al disclose a combination of reflective surfaces and refractor structures intended to maximize illumination of an outdoor sign given a predetermined amount of generated light. Reibling, in U.S. Pat. No. 4,188,657, describes luminaires intended for the illumination of outdoor signs and being capable of producing light patterns by means of combinations of reflective surface finishes on reflective surfaces of the disclosed luminaires. In U.S. Pat. No. 4,261,030, Hernandez discloses lighting fixtures having horizontally disposed lamps with parabolic reflectors mounted one each behind each of the lamps such that light is directed onto a surface that is to be illuminated. Hernandez discloses auxiliary reflectors in addition to a primary reflector, the combination of reflective surfaces directing light onto a surface that is to be illuminated. U.S. Pat. No. 4,398,239 to de Vos et al discloses a luminaire intended for illuminating roadways and the like including a reflector capable of being removed from a weather-tight housing that also mounts a light source in an operative relation with the reflector. Odle et al, in U.S. Pat. No. 4,451,875, disclose a luminaire intended for illumination of a billboard or the like, the luminaire including reflective surfaces and a light source disposed between the reflective surfaces and a surface of the sign that is to be illuminated. The Odle et al luminaire utilizes refractive structures disposed on and formed integrally with a transparent cover that also comprises a portion of a weather-tight housing. The refractive structures of Odle et al function in concert with reflective surfaces to direct light onto a vertical surface that is to be illuminated such as the face of a billboard or similar outdoor sign. In U.S. Pat. No. 4,559,587, Quiogue et al disclose a luminaire having both reflective surfaces and refractor structures that function cooperatively to direct light onto an objective. Hammond, in U.S. Pat. No. 4,575,783, discloses a reflector configured to direct light emanating from a light source to all areas of an outdoor sign to create a uniform distribution of light on the face of the sign. Light is redirected by the Hammond reflector to portions of the sign surfaces that are not evenly illuminated with an appropriate intensity by light directly incident on the face of the sign from the light source. In U.S. Pat. No. 4,954,935, Hammond et al disclose a lighting system for illuminating an outdoor billboard or the like formed of a number of panels. The system disclosed by Hammond et al utilizes a number of luminaires, one for each panel of the sign. Hammond et al disclose use of a metal halide lamp with reflectors fixed within a lamp housing. The reflectors are positioned behind the lamp and reflect light radiating from the lamp onto the sign surface that is to be illuminated. The reflector of Hammond et al is provided with a number of flutes or reflecting segments. U.S. Pat. No. 4,337,507 to Lasker describes lighting fixtures with directional distributions. Luminaires disclosed by Lasker are provided with a prismatic unit and a reflector unit intended to reduce the amount of light escaping at excessively high angles as is often found with floodlighting luminaires. The prismatic unit disclosed by Lasker employs vertical ribs for directing light produced by a light source and further provides a lateral distribution of light at extremely wide angles as well as illumination behind the aperture of a housing that encloses the prismatic unit and the reflector unit. The light distribution provided by the Lasker structure does not provide a light distribution that can be focused evenly and wholly onto a surface of a vertically oriented billboard or the like. Lasker employs a reflector having a cylindrically and parabolically shaped contour for production of a uniform horizontal distribution of light. Lasker pivots a light source and reflector unit within the housing about a fixed horizontal axis to adjust vertical cut-off angles and angles of maximum intensity. However, the structure of Lasker is not configured for full and even illumination of a vertical surface of a sign or the like as is required for illumination of outdoor advertising signs and the like. Thoman et al, in U.S. Pat. No. 3,358,133, disclose a floodlight having a primary reflector formed in a scoop-like configuration, the reflector being hinged to a supporting frame. A semi-cylindrical auxiliary reflector cooperates with the primary reflector to produce a wide beam uniformly distributed over a large area as is intended by the use of the Thoman et al luminaire as a floodlight. Thoman et al do not disclose optics intended for effective illumination of a vertical surface of an outdoor sign or the like. Subisak et al, in U.S. Pat. Nos. 5,188,453; 5,588,742 and 5,664,878, describe luminaires intended for mounting on a periphery of a sign to illuminate a sign face from internally of such a sign.

As is evidenced by the disclosures of the prior art including those United States patents referred to above, it is seen that substantial efforts have previously been expended toward the goal of uniform illumination of vertical surfaces of billboards, outdoor signs and the like, such illumination being intended to be uniform as well as of a sufficient intensity to permit legible viewing of indicia formed on a sign face and with a desirable utilization of generated light. Although optical systems intended for outdoor sign illumination have taken a number of forms and have been positioned both below and above sign faces, it can be appreciated that improvements in the luminaires themselves are needed in order to maximize light utilization and to reduce light spillage in order to conserve resources including costs required for sign installations. A further intent in the art has been to provide luminaires having efficiencies permitting the utilization of fewer luminaires for illumination of a surface of given dimensions. The present invention addresses these long-felt needs in the art by providing reflective assemblies of particular configuration and that are capable of movement within housings each mounting a light source and reflector structure. The reflective structures of the invention can be formed with reflective surfaces comprised of materials of differing reflectivity in order to tailor light for particular use situations. The reflective structures of the invention further cooperate with refractor structures carried by luminaire housings for redirecting light onto sign surfaces with a minimum of light spillage. The luminaires of the invention exhibit efficiencies permitting utilization of fewer luminaire structures for illumination of sign surfaces of given dimensions. The present invention thus provides substantial advances in the art as will be further appreciated in view of the following disclosure of the several embodiments of the invention.

SUMMARY OF THE INVENTION

In the several embodiments of the invention explicitly disclosed herein, the invention provides luminaires intended for illumination of billboards, outdoor signs and similar vertical surfaces and which are capable of uniformly illuminating surfaces of said signs with desired intensity over full surfaces of said signs and with reduced light spillage about edges of such signs. The luminaires of the invention provide improvement over the prior art by the provision of highly efficient primary reflector structures preferably mounted for movement within housings in operative juxtaposition to a light source within each of the housings, each housing being sealed against environmental affects by means of a transparent lens that also functions as a cover. The lens is formed with refractor elements preferably disposed on surfaces of the lens disposed interiorly of the housing. Refractive elements are provided only on portions of the lens and take the form of prisms of differing configuration selected for redirecting light from portions of reflective surfaces of said luminaire to illuminate particular portions of an outdoor sign. Particular shapes of primary reflector structures act to reduce spill light, said reflector structures in certain embodiments being formed of differing metals having different optical characteristics to further enhance sign illumination uniformity while maintaining high average sign illuminance. Primary reflector structures of the invention are preferably provided with side reflectors on each lateral side of each of the primary reflectors, the side reflectors being positioned to increase sign illumination and to decrease spill light. Reflector assemblies formed of the primary reflector structures and associated side reflectors are preferably mounted for pivoting or sliding movement internally of luminaire housings for adjustment of a light pattern directed onto a particular sign. Reflector assembly adjustment can be effected at a manufacturing location or on site. Refractive prisms formed on the transparent luminaire lens refocus direct light from both the light source and the reflector assembly to increase uniformity of illumination and to reduce spill light. Spill light into the night sky is reduced by more than half relative to prior art sign luminaires through use of the present luminaires with improved uniformity of illumination.

Primary reflector structures configured according to the invention essentially take the form of compound parabolic elements formed of smoothly curved sections or reflective segments. Portions of said primary reflectors can be formed of or surfaced with reflective metals having differing optical characteristics such as diffuse, semi-diffuse and specular reflective characteristics. Use of reflector surfaces formed of differing metals having such characteristics allow light to be reflected to form virtual images of the light source distributed over surfaces of the sign with a resultant increase in sign illumination intensity and uniformity of illumination.

Refractive prisms formed along an uppermost portion of the cover act to reduce up-spill light by redirecting light onto top edges of a sign. Prisms located at the bottom portion of the refractor reduce down-spill light by lifting light that would otherwise spill toward bottom corners of a sign.

Efficiencies occasioned by use of the present luminaires permit the use of fewer luminaires for adequate illumination of signs of predetermined dimensions. In the prior art, luminaires intended for illumination of billboards, outdoor signs and the like are capable of desirable illumination of signs of standard dimensions through the use of at least four luminaires. The luminaires of the present invention are capable of desirable illumination of billboards and outdoor signs of the same dimensions through the use of only three of the present luminaires. In other words, in a typical outdoor sign illumination environment, at least four luminaires have been required in the prior art while systems configured with the present luminaires allow the use of only three luminaires for illumination of signs of dimensions previously requiring the use of four prior art luminaires.

Accordingly, it is an object of the invention to provide luminaires intended for illumination of billboards, outdoor signs and the like and which are capable of providing uniform light distribution over full surfaces of said billboards without spillage of light about edges of said billboard.

It is another object of the invention to provide reflector assemblies mounted for adjusting movement within luminaire housings so that the luminaire can be modified either during manufacture or on site for efficient illumination of signs of differing shape and dimension.

It is yet another object of the invention to provide luminaires capable of uniform illumination of billboards and the like with minimum light spillage whereby primary reflectors of curvilinear shape function with refractive prisms carried by the luminaires to direct and/or redirect light onto vertical surfaces of the billboard, said primary reflectors being either smoothly curved or segmented and preferably having side reflectors associated therewith to form reflector assemblies, said side reflectors being either planar, curved or parabolic, or faceted for extremely efficient direction of light onto such a billboard or through refractive prisms carried by luminaire housings for redirecting light onto said billboard.

It is a further object of the invention to provide a luminaire intended for mounting in front of a large panel such as a billboard for illumination of said panel, the luminaire being formed of a housing, a light source disposed within the housing, a primary reflector movably affixed within the interior of the housing for directing light from the light source both directly to surfaces of the panel to be illuminated and to refractive prisms preferably disposed on interior surfaces of a covering lens completing the housing and transparent to light emanating from the light source, from the primary reflector and from side reflectors associated with the primary reflector, the reflective surfaces and the refractive prisms acting to focus light from the light source onto surfaces of the panel with desirable intensity and uniformity and with reduced light spillage.

Yet another object of the invention is to provide a sign lighting luminaire having refractive areas of both prismatic and non-prismatic characteristics disposed on a transparent cover and preferably internally of said cover, these refractive elements being formed in sections disposed at varying locations of the cover and orientations for acting with reflective surfaces of the luminaire to direct light onto a billboard or the like with desirable illumination intensity and uniformity while reducing light spillage.

Still another object of the invention is to provide an outdoor sign illumination system capable of evenly and efficiently illuminating a billboard or the like, said billboard having a typical length-wise dimension of approximately 48 feet in a horizontal sense, such a billboard being fully illuminated by as few as three luminaires configured according to the invention, the luminaires of the invention being capable of illuminating billboards of differing dimensions with fewer luminaires than are required through use of luminaires configured according to the prior art.

Further objects and advantages of the invention will become more readily apparent in light of the following detailed description of the preferred embodiments of the invention.

BRIEF DESCRIPTION OF THE DRAWINGS

FIG. 11 is a schematic representation of a second embodiment of refractive structures formed according to the invention, the refractive structures including continuous prisms;

FIG. 12 is a schematic representation of a potion of a cover configured according to the invention and having refractive portions including three prismatic sections;

FIG. 13 is a schematic representation of a further embodiment of refractive structures configured according to the invention and having prismatic sections only along a particular portion of a lens;

FIG. 14 is a perspective view of a lens configured according to the invention and absent prisms, the lens so configured functioning to refract light incident on at least portions thereof to redirect light onto a surface to be illuminated;

DESCRIPTION OF THE PREFERRED EMBODIMENTS

The disclosures of U.S. Pat. Nos. 4,037,341; 4,188,657; 4,261,030; 4,451,875; 4,575,783; and 4,954,953 are incorporated hereinto by reference, these patents disclosing luminaire structures essentially capable of illumination of billboards, outdoor signs and the like, the disclosures of these patents providing information additional to the disclosure provided herein and which further teach a person of ordinary skill in the art to make and use the present invention.

Figure 1:
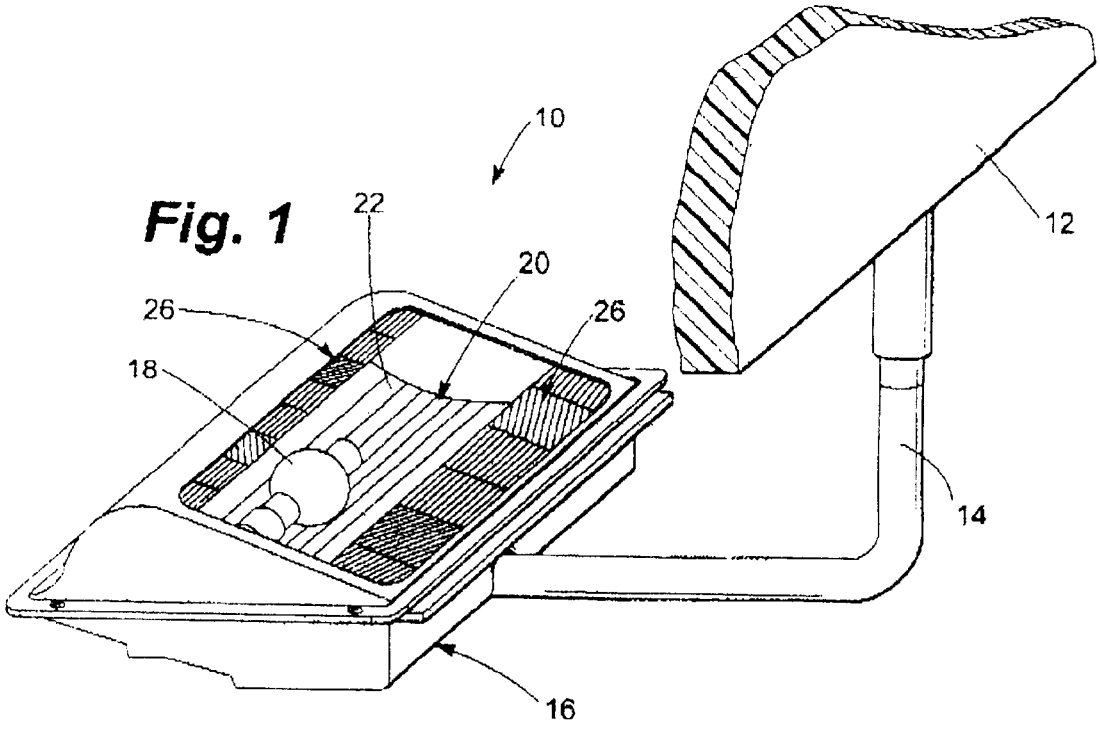
FIG. 1 is a perspective view of a representative luminaire configured according to the invention for illumination of an outdoor sign or the like and shown mounted in operative relation to said sign.

Referring now to the drawings and particularly to FIG. 1, a luminaire configured according to a representative embodiment of the invention is seen at 10 to be mounted in an essentially conventional manner relative to a panel 12 representative of an outdoor sign, billboard or the like and which typically has a vertical face to be illuminated, the face of the panel 12 that is to be illuminated by the luminaire 10 not being seen in FIG. 1. In a typical use environment, a vertical face of a billboard or sign as represented by the panel 12 has indicia conveying advertising messages and the like, the luminaire 10 being intended to illuminate the indicia on the vertical face of the panel 12 so that the indicia is legible such as during nighttime hours. The luminaire 10 is mounted in spaced relation from the panel 12 and slightly beneath a lower edge thereof by means of a conventional mounting which can include a support 14 that takes the form of a conduit, pipe or the like. The support 14 acts to maintain a pre-determined distance between the luminaire 10 and the panel 14 and is configured in a conventional manner to prevent rotation of the luminaire 10 after leveling and tightening of said luminaire 10 onto the support 14. Positioning of the luminaire 10 relative to the panel 12 varies according to particular use situations. Usual practice in the industry requires a spacing of the luminaire 10 from the panel 12 at a distance of approximately 42 inches outwardly from a bottom edge of the panel 12 in order to accommodate a maintenance catwalk commonly used for periodic maintenance and indicia changeout.

Figure 2A:
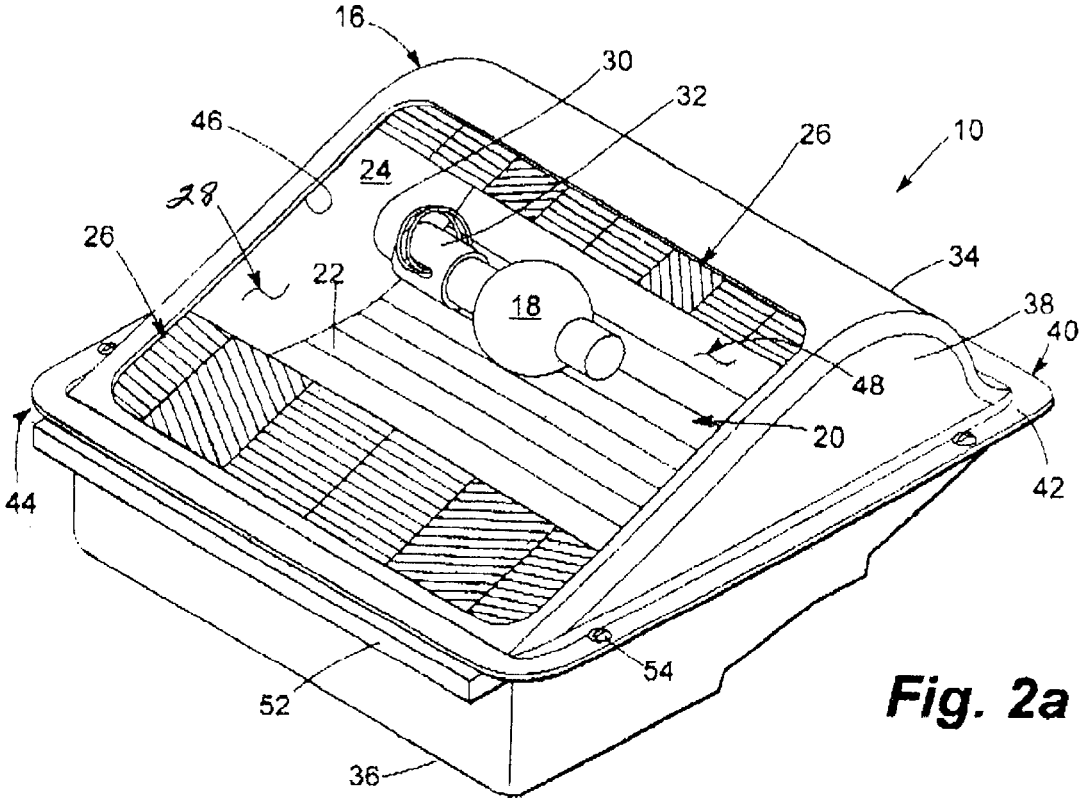
FIG. 2A is a perspective view of a representative embodiment of the invention illustrating details of said luminaire.

Referring now also to FIG. 2A, the support 14 is directly attached to a housing 16 within which a lamp 18 is mounted and connected to a source of electrical power in a conventional manner. A reflector assembly is seen at 20 to be formed of a primary reflector 22 and at least one side reflector 24. As is seen in FIGS. 1 and 2A, one of the side reflectors 24 is seen in FIG. 1 and the other side reflector 24 is seen in FIG. 2A. The reflector assembly 20 functions as will be described hereinabove to direct light from the lamp 18 directly onto the panel 12 or to a series of refractors 26 formed in or on a transparent lens 28, the lens 28 being preferably formed of pressed borosilicate glass according to conventional practice. The lens 28 could also be formed of acrylic polymeric material as is also conventional in the art.

The lamp 18 is positioned between the reflector assembly 20 and the surface of the panel 12 that is to be illuminated. An opening 30 formed in one of the side reflectors 24 receives a socket 32 for conventional mounting of the lamp 18 within the luminaire 10. The socket 32 is typically formed of porcelain and is enclosed, factory prewired and is nickel plated or formed of stainless steel for corrosion resistance, safety, positive hold and ease of lamp replacement. In the embodiment shown in FIGS. 1, 2A, and additionally in 2B, the lamp 18 is seen to be disposed in a horizontal orientation, that is, the longitudinal axis of the lamp 18 is horizontally disposed when the luminaire 10 is positioned in an operational environment such as that shown in FIG. 1. The lamp 18 typically takes the form of a super metal halide lamp capable of generating approximately 39,000 lumens. It is to be understood, of course, that the luminaire 10 could be mounted in orientations such that the lamp 18 would be located in a vertical orientation or in other positions without departing from the scope of the invention. Essentially, the lamp 18 in this embodiment of the invention is horizontally disposed within the housing 16 of the luminaire 10.

Figure 2B:
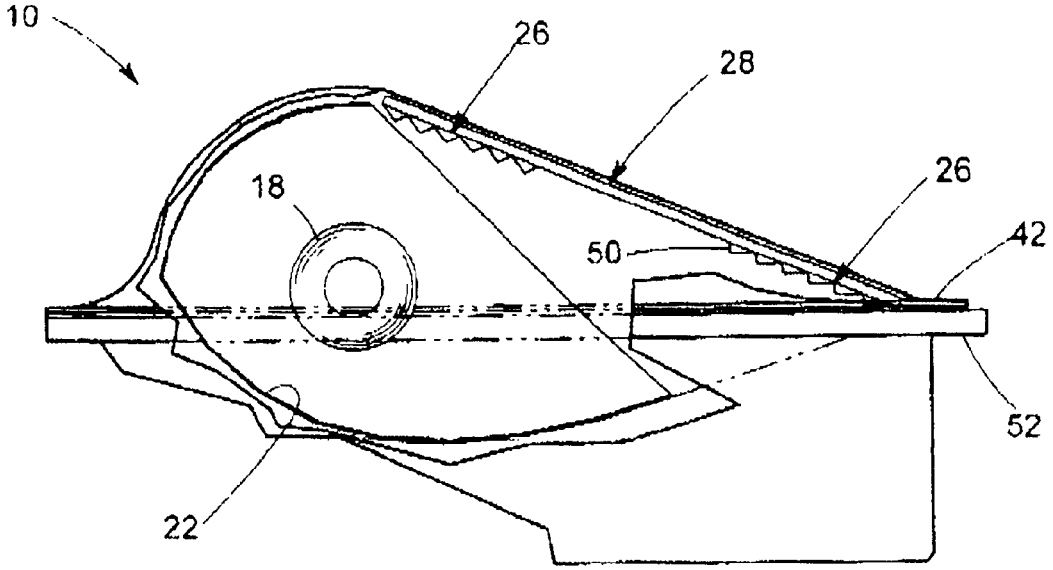
FIG. 2B is a side elevation of the luminaire of FIG. 2A and particularly illustrating refractive structures integrally formed interiorly of the luminaire on a transparent lens that forms a portion of covering structure permitting formation of a weather-tight assembly.
Figure 3:
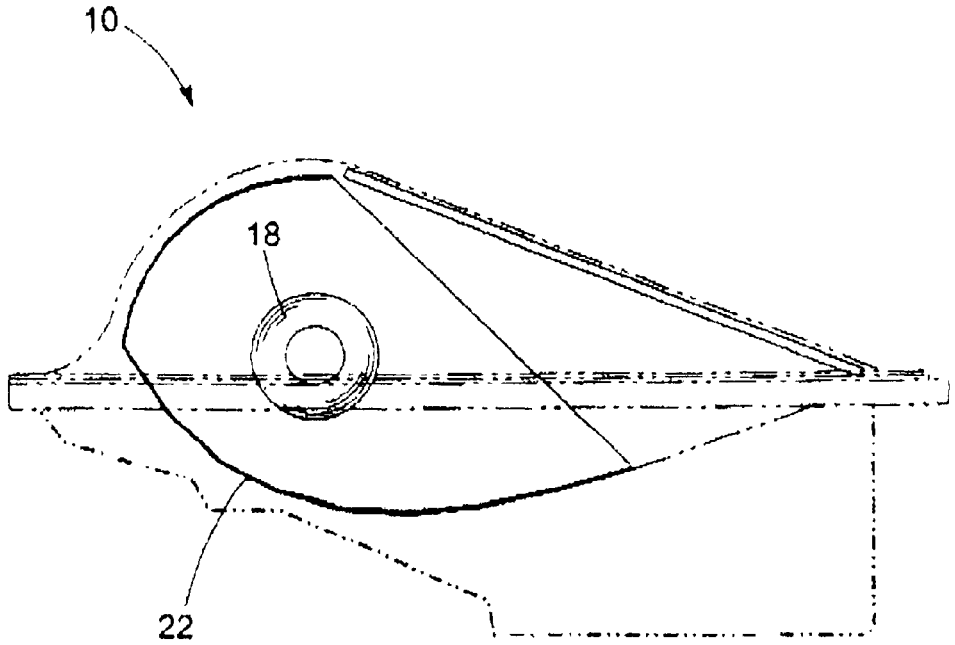
FIG. 3 is a diagrammatical representation of a side elevational view of a representative luminaire configured according to the invention and with lower housing portions removed for simplicity.

The housing 16 is formed of an upper cover member 34 and a lower member 36, the upper cover member 34 having a body portion 38 that curves upwardly from an outward edge 40 of a peripheral flange 42 to form a rounded upper surface which then slants downwardly toward a front edge 44 of the flange 42. The central body portion 38 of the upper cover member 34 is shaped to accommodate portions of the primary reflector 22 as will be discussed in detail hereinafter. The upper cover member 34 has an enlarged opening 46 formed in that part of the body portion 38 which slopes downwardly over a front face of the cover member 34. The enlarged opening is substantially square with rounded corners as shown and provides an aperture through which light generated by the lamp 18 and reflected by the reflector assembly 20 can exit the luminaire 10. The lens 28 is disposed effectively within the opening 46 such that all light passing through the opening 46 must pass through the lens 28. Light passes either through a central portion 48 of the lens 28 without being redirected as occurs when light from either the lamp 18 or reflected from the reflector assembly 20 is incident on the central portion 48 or is redirected when incident on various prismatic sections of the refractors 26. The light incident on the refractors 26 is redirected onto the panel 12 as will be described hereinafter. Certain of the refractors 26 are disposed along an upper edge of the lens 28 while certain others of the refractors 26 are disposed along a lower edge of the lens 28, the refractors being of a prismatic nature and preferably being directly formed into the lens 28 and located on interiorly disposed surfaces of the lens 28 as is shown particularly in FIG. 2B. As is seen in FIG. 2B, the lens 28 essentially comprises a body portion which is substantially rectangular in section but with prisms 50, shown as representations, formed integrally with the lens 28. In the art, the refractors 26 of prismatic nature are referred to as internal prisms when disposed on or formed integrally with interior surfaces of a lens or transparent cover positioned over an aperture of a luminaire. The lens 28 is mounted relative to the upper cover member 34 in a conventional manner so as to prevent leakage of moisture into the interior of the luminaire 10. The material from which the lens 28 is formed is chosen to be thermally shock resistant glass or transparent polymeric material which is not damaged by rain, snow or extreme weather conditions such as heat, direct sunlight, etc. The lens 28 is formed with a smooth outer surface which is effectively self-cleaned by rain.

As indicated above, the housing 16 is completed by joining of the lower member 36 to the upper cover member 34. The lower member 36 can be seen in FIGS. 1 and 2A to be essentially box-like toward a forward portion thereof, the thickness of the lower member 36 being step-wise reduced toward an outward end of the luminaire 10, this particular shape of the housing 16 being volumetrically efficient as well as visually attractive. Essentially, the lower member 36 is shaped in the manner shown since it is not necessary for the lower member 36 to be as thick outwardly of the luminaire 10 as is required on an opposite lateral portion of said luminaire 10. The lower member 36 is provided with a peripheral lip 52 which mates with the peripheral flange 42 of the upper cover member 34, the lip 52 and flange 42 having aligned holes drilled therein (not shown) for receiving screws 54 in a conventional manner to fasten the members 34, 36 together to form the housing 16. Although not shown in the drawings, gaskets are provided between the lip 52 and flange 42 in a conventional manner to seal the housing 16. Sealing structure (not shown) also seals the lens 18 within the opening 46 formed in the upper cover member 34.

In a manner essentially conventional in the art, the upper cover member 34 can be hinged to the lower member 36 so that the upper cover member 34 can act essentially as a door and be pivoted upwardly on removal of the screws 54 to expose the interior of the luminaire 10 for maintenance and the like. As is also conventional, the lens 18 can essentially take the form of an integral glare shield supporting the refractors 26. As is further conventional in the art, hinge components (not shown) useful for attaching the members 34, 36 can be die-cast integrally with said members 34, 36. Supports (not shown) can be conventionally provided for the upper cover member 34 and the like when the member 34 is pivoted past vertical such as by an integral cast hinge stop (not shown). The assembly provided by the housing 16 prevents entry of snow and wind-driven rain into the interior of the luminaire 10, the assembly being UL listed as "wet location" at 40° C. and meeting UL 1572 rain test requirements. The housing 16 further is configured to mount easily to either new or existing signs through the use of conventional expedients.

Luminaires such as the luminaire 10 configured according to the present invention efficiently function to uniformly illuminate a billboard, outdoor sign or the like as represented by the panel 12 by means of novel features including reflectors formed into novel configurations, such reflectors functioning in concert with refractor elements disposed on or formed with the lens 28, vertical surfaces of the panel 12 being illuminated with high average illuminance of a desirable intensity with minimal light spillage around peripheral edges of the panel 12. Primary reflectors of the invention such as the primary reflector 22 can be formed into smoothly continuous curvilinear shapes according to the invention or formed into similar shapes having lateral segments that function as facets. The primary reflectors of the invention can be utilized with one or more reflective structures such as the side reflectors 24, said side reflectors 24 being formed of planar reflective sheets, reflective surfaces of curved or parabolic conformation or formed by segmented reflective surfaces, such side reflectors combining with the primary reflectors of the invention to form reflector assemblies exhibiting increased efficiencies causative of improvement in light intensity and uniformity over full surfaces of a sign such as the panel 12 with minimal light spillage about edges of said panel 12. In combination with refractors of differing orientation and functionality such as the refractors 26, the reflector assemblies 20 of the invention provide the particular operational improvements described herein.

In preferred embodiments of the invention, reflector assemblies such as the reflector assembly 20 can be affixed within the housing 16 by structure permitting movement of said reflector assembly 20 in order to permit adjustment of the position of the reflector assembly 20 in order to maximize effectiveness of the luminaire 10 in differing use environments. The position of the reflector assembly 20 can be fixed during manufacture or on site, structure mounting the reflector assembly 20 for movement within the housing 16 preferably being capable of rapid adjustment on site to allow alteration of the position of the reflector assembly 20 within the housing 16. It is to be understood that the adjustments intended do not require a substantial degree of movement of the reflector assembly 20. The present luminaires 10 in the several embodiments thereof permit the use of fewer luminaires for illumination of outdoor signs of substantial horizontal dimensions when compared to luminaires of the prior art as will be further described hereinafter.

Figure 4A:
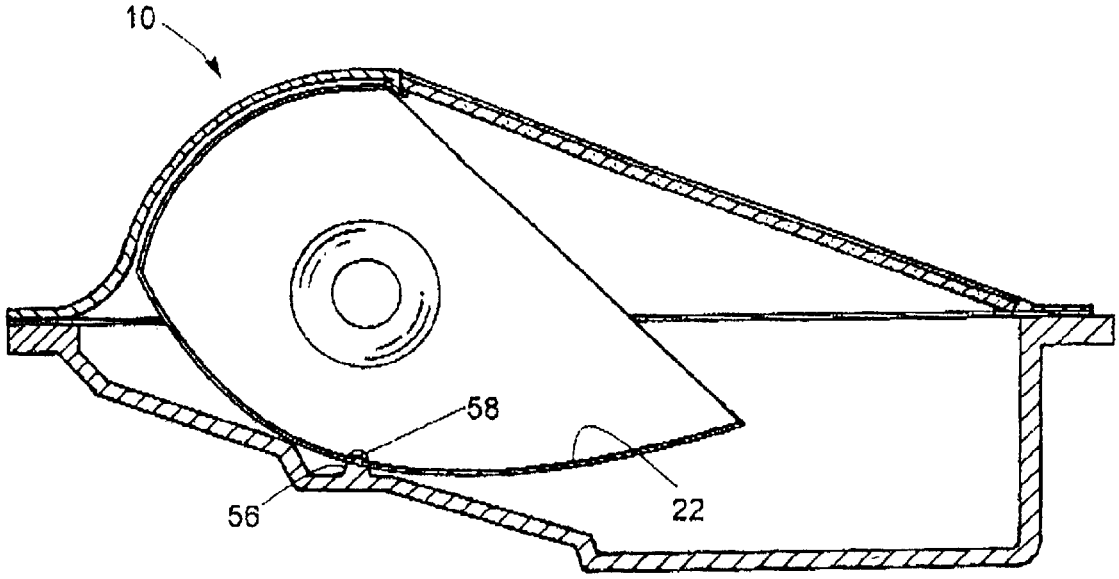
FIG. 4A is a side elevational view in section of a luminaire configured according to the invention and illustrating structure for movably mounting a reflector assembly within the interior of a luminaire housing.
Figure 4B:
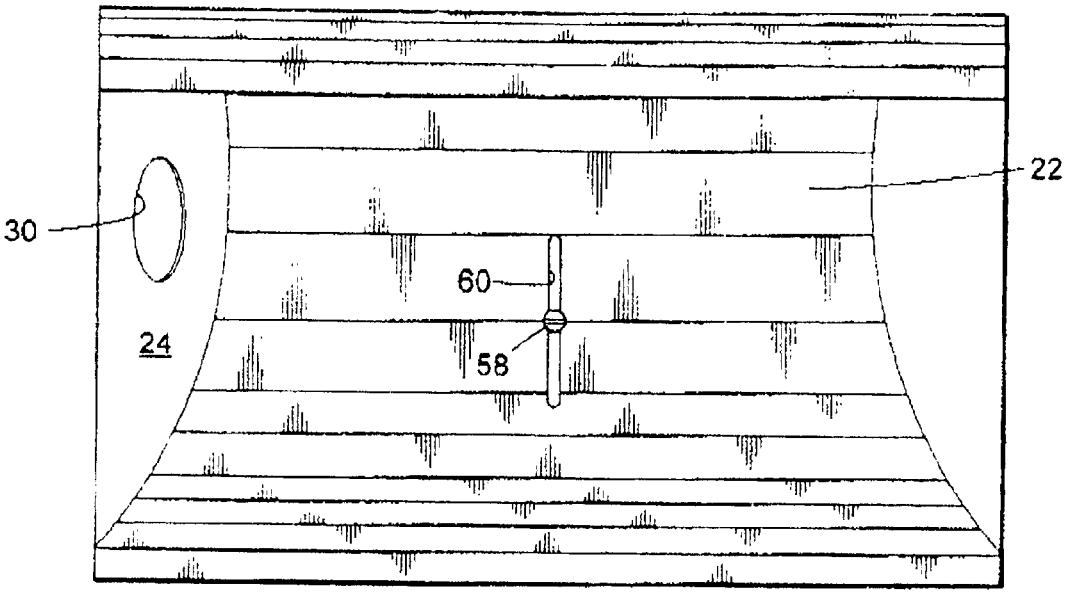
FIG. 4B is a top view of the reflector of FIG. 4A with housing portions removed and illustrating a further feature of the mounting structure.

Referring now to FIGS. 4A and 4B, the luminaire 10 is seen in a side elevational view in section in FIG. 4A to have a boss 56 extending from an interior surface of the lower member 36 at a location beneath the reflector assembly 20. The boss is provided with a threaded aperture (not shown) formed in an upper portion thereof, the threaded aperture of the boss 56 receiving a threaded screw 58 through slot 60 formed in the reflector assembly 20 as seen in FIG. 4B. The screw 58 can be readily manipulated by means of a simple screwdriver to be loosened to allow adjusting movement from "front to back" of the luminaire 10 and essentially in a pivoting manner, thereby to adjust the location of the reflector assembly 20 so as to conform to the exigencies of a particular use situation. In the event that sufficient information is available during manufacture relative to the intended use environment of the luminaire, the reflector assembly 20 can be fixed in place during manufacture. Alternatively, the reflector assembly 20 can have its position adjusted within the housing 16 on site so that a preferred positioning of the reflector assembly can be chosen. In the event that the luminaire 10 is subsequently used in another use situation, then the location of the reflector assembly 20 can be changed in order to maximize performance in that subsequent use situation. The boss 56 is preferably formed with a rounded distal end as is shown in FIG. 4A in order to facilitate freedom of movement. Other mechanical expedients can be employed for permitting movable mounting of the reflector assembly 20 within the housing 16 without departing from the scope of the invention. In particular, track elements (not shown) can be provided on interior walls of the housing 16 with track following pins (not shown) disposed on the reflector assembly 20. Such pins are then engageable with such track elements in order to permit movement of the reflector assembly 20. A high friction fit of pins within such track elements can be provided to hold the reflector assembly 20 in a desired position within the housing 16. Alternatively, structure such as is shown in FIGS. 13A through 13D of U.S. Pat. No. 6,193,395 or as shown in FIGS. 25A through 26C in U.S. Pat. No. 6,142,648 can be adapted for use with the present structure among other mechanical expedients. When using the structures described in U.S. Pat. Nos. 6,193,395 and 6,142,648 that is, structures similar thereto, track elements mounted essentially to an underside of the reflector assembly 20 can move within track structure formed on interior floor surfaces of the lower member 36. It is to be understood that the reflector assembly 20 of the luminaire 10 of the invention need only move short distances, typically of less than fractions of an inch, and need not be moved but a very few times and perhaps only once during the lifetime of the luminaire 10. The mechanical expedients referred to herein can be generally described as bracket structures, various forms of brackets being configurable to provide the intended function.

Figure 5A:
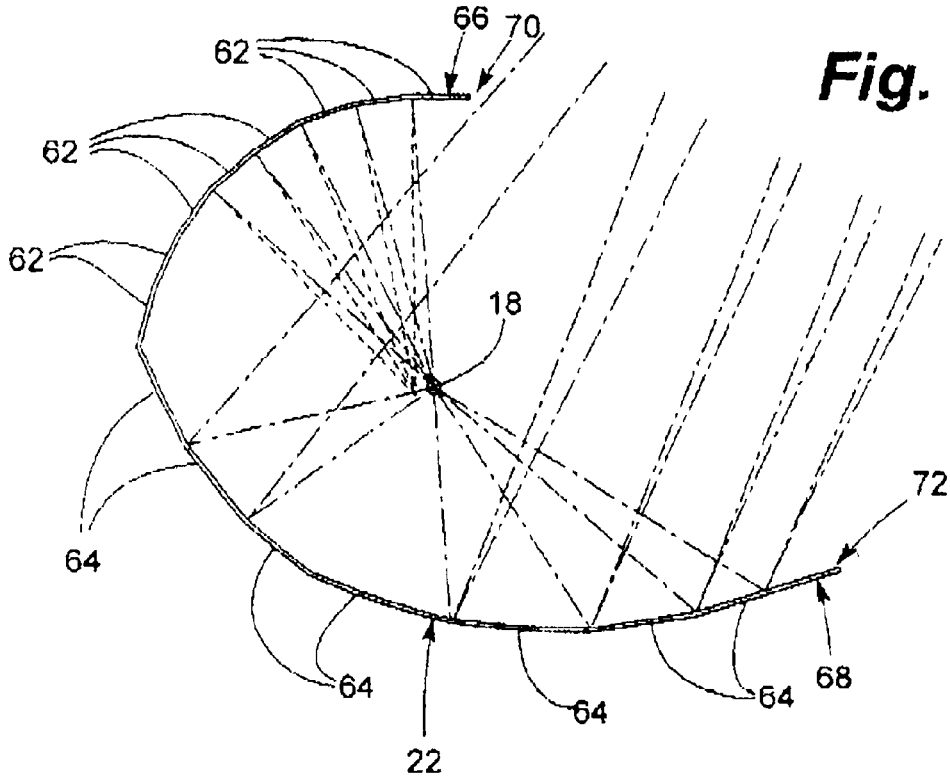
FIG. 5A is a side elevation in section of a first embodiment of a primary reflector configured according to the invention.
Figure 5B:
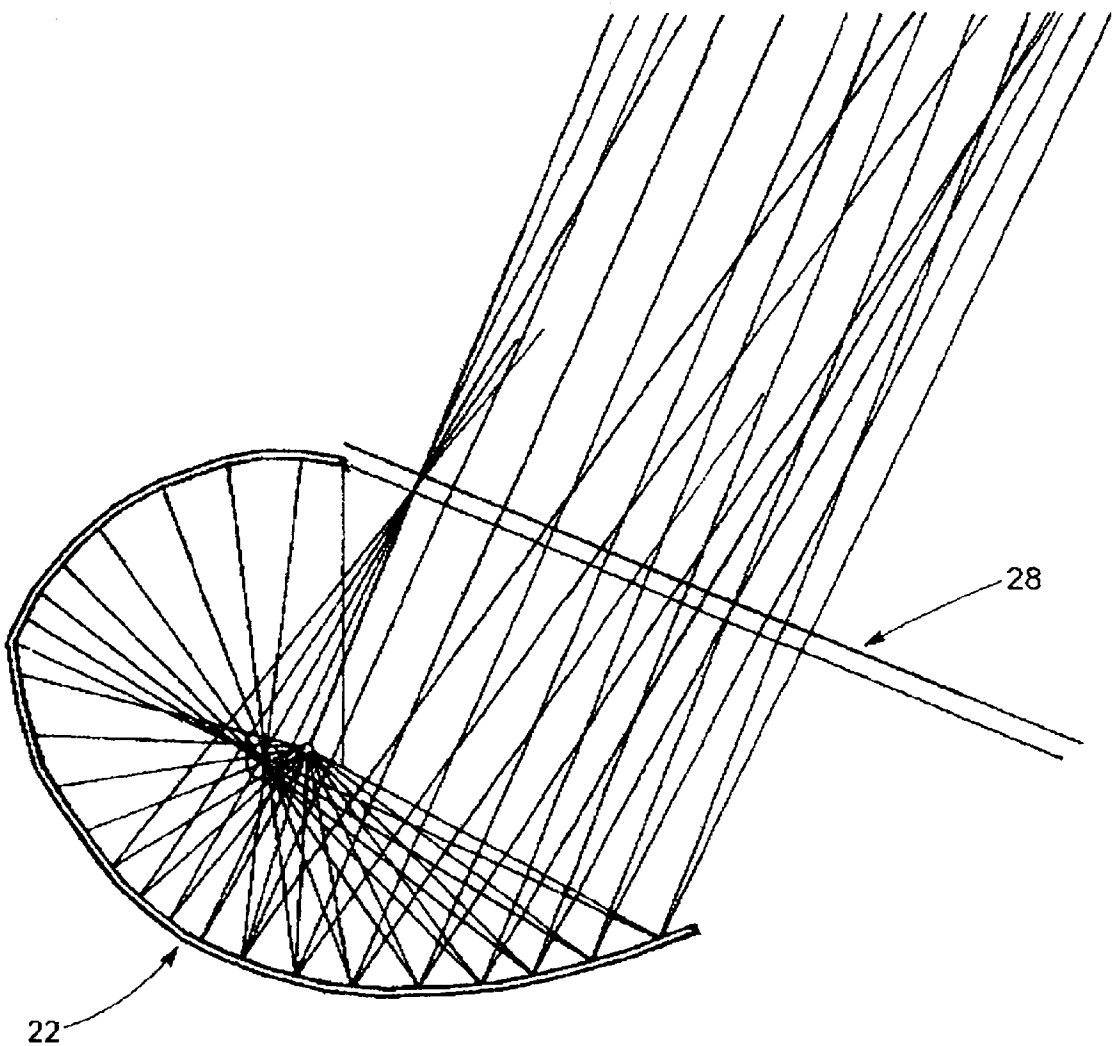
FIG. 5B is a diagrammatical view of the primary reflector of FIG. 5A illustrating reflection of light from said reflector.
Figure 5C:
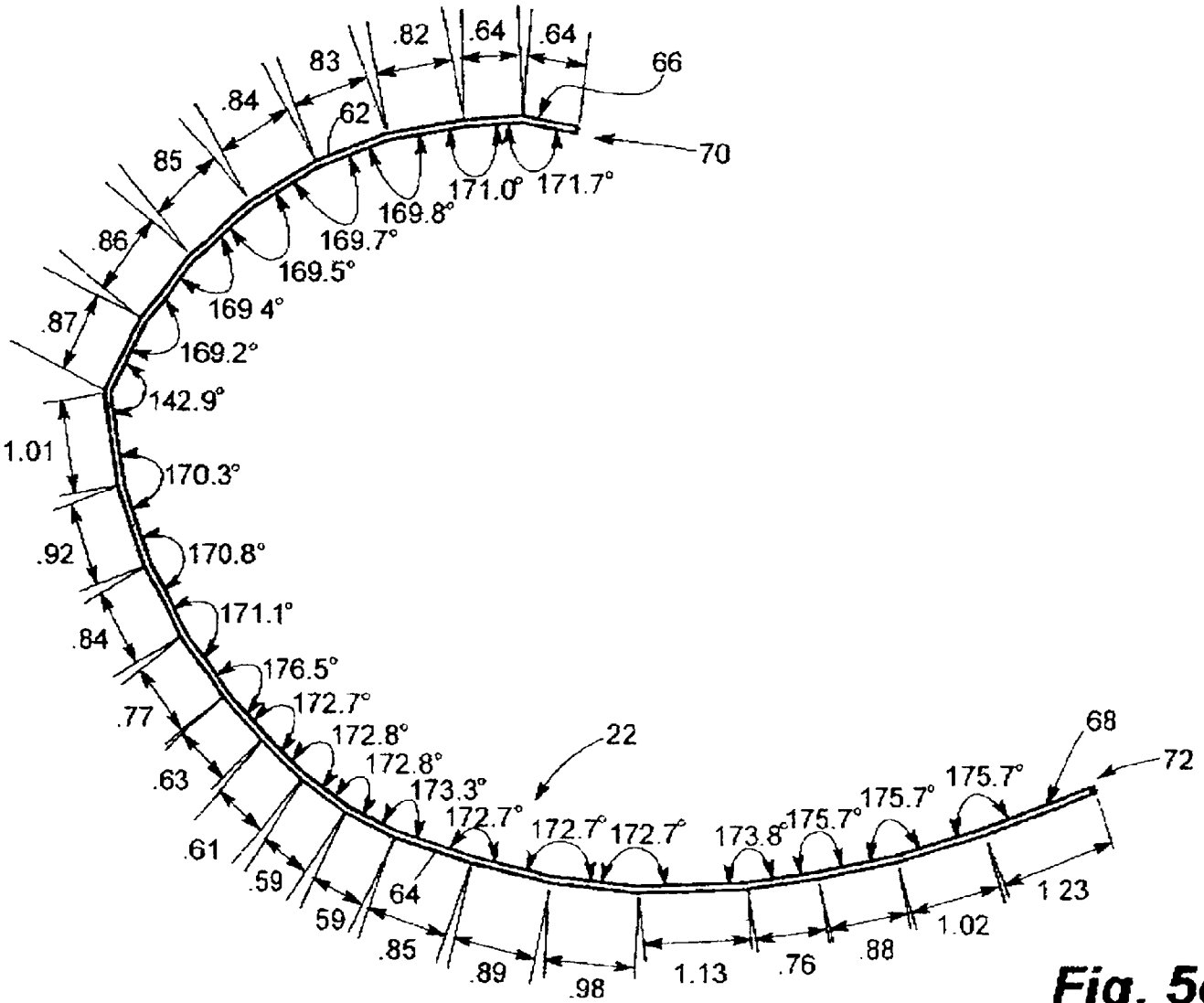
FIG. 5C is a diagrammatical view of the segmented primary reflector of FIGS. 5A and 5B with dimensions affixed to illustrate a particularly effective shape of said reflector.

Referring now to FIGS. 5A, 5B and 5C, the primary reflector 22 configured according to one embodiment of the invention is seen in elevation to have a generally curvilinear shape, the reflector 22 of FIGS. 5A through 5B being formed of planar segments 62 and 64, the segments 62 forming an upper arcuate portion 66 of the reflector 22 with the reflective segments 64 forming a lower arcuate portion 68, the adjoining segments 62 and 64 having an angle between the planes thereof which is much less than the angles between the respective segments 62 and the respective segments 64. The preferred angle as noted in FIG. 5C between the adjacent segments 62, 64 is 142.9°. Effectively, the upper arcuate portion 66 and the lower arcuate portion 68 of the primary reflector 22 are thus "bent" relative to each other to thereby form said portions 66, 68. In FIG. 5C, the widthwise dimension of each of the segments 62, 64 in inches are given in the drawing and will not be reproduced in the text for purposes of simplicity. Further, the angles between the respective segments 62 and between the respective segments 64 are also given in FIG. 5C and will not be reproduced in this text. It is to be understood that the segmented reflector of FIG. 5C is a preferred configuration of a segmented reflector although segmented primary reflectors configured according to the invention can be otherwise formed with differing dimensions and angular relationships without departing from the scope of the invention.

FIG. 5B illustrates the pathways taken by light rays produced by the lamp 18 shown essentially as a virtual light source in FIG. 5B and either directly passing to a surface to be illuminated or being reflected by the primary reflector 22. Certain of the rays reflected from the primary reflector 22 pass through the central portion 48 of the lens 28 and onto surfaces of the panel 12 which are to be illuminated. Light rays directly emanating from the lamp 18 also pass directly through the central portion 48 of the lens 28 and onto the panel 12. Other light rays reflected by the primary reflector 22 pass through the refractors 26 and are redirected onto the panel 12. Without the refractors 26 at upper and lower portions of the lens 28, at least some of these light rays would not be incident on the panel 12 and would be wasted as "spillage", thereby creating light pollution. U.S. Pat. No. 4,451,875, assigned to a predecessor corporation of the present assignee, also utilizes a combination reflector/refractor arrangement for increasing illumination from a given light source to vertical surfaces of a billboard, outdoor sign or the like. U.S. Pat. No. 4,451,875 is incorporated hereinto by reference as indicated hereinabove. As seen in FIG. 5B, the lens 18 is shown in a representational manner only. Referring now again to FIG. 5A as well as FIG. 2A, it is to be seen that the upper arcuate portion 66 of the primary reflector 22 extends upwardly of and slightly forwardly of the lamp 18 as said structural elements are properly disposed within the interior of the luminaire 10. The juncture of the portions 66, 68 of the primary reflector 22 is preferably disposed rearwardly of the lamp 18 with said juncture being slightly above a horizontal plane taken through the lamp 18. The lower arcuate portion 68 of the primary reflector 22 extends downwardly from said juncture in an arcuate path to pass directly beneath the lamp 18 and to extend past both a terminating edge 70 of the portion 66 to a terminating edge 72 of the portion 68, said terminating edge 72 extending approximately as far beyond the terminating edge 70 as the terminating edge 70 extends beyond the juncture between the portions 66 and 68. Further, the terminating edge 72 of the reflector 22 is disposed above portions of the lower arcuate portion 68 lying beneath the lamp 18 and also beneath the terminating edge 70 of the upper arcuate portion 66. In essence, the lower arcuate portion 68 curves downwardly from the juncture between said portions 66, 68 to a certain location and then recurves upwardly to the terminating edge 72 at the lowermost distal end of the reflector 22. This upwardly recurved section of the portion 68 is configured to direct a portion of the light emanating from the lamp 18 directly to certain of the refractors 26 rather than to permit these light rays to wastefully be incident upon interior surfaces of the housing 16. As will be described hereinafter, the portions 66, 68 of the primary reflector 22 can be formed of metals having differing reflectivity characteristics in order to further improve illumination of the panel 12.

Figure 6A:
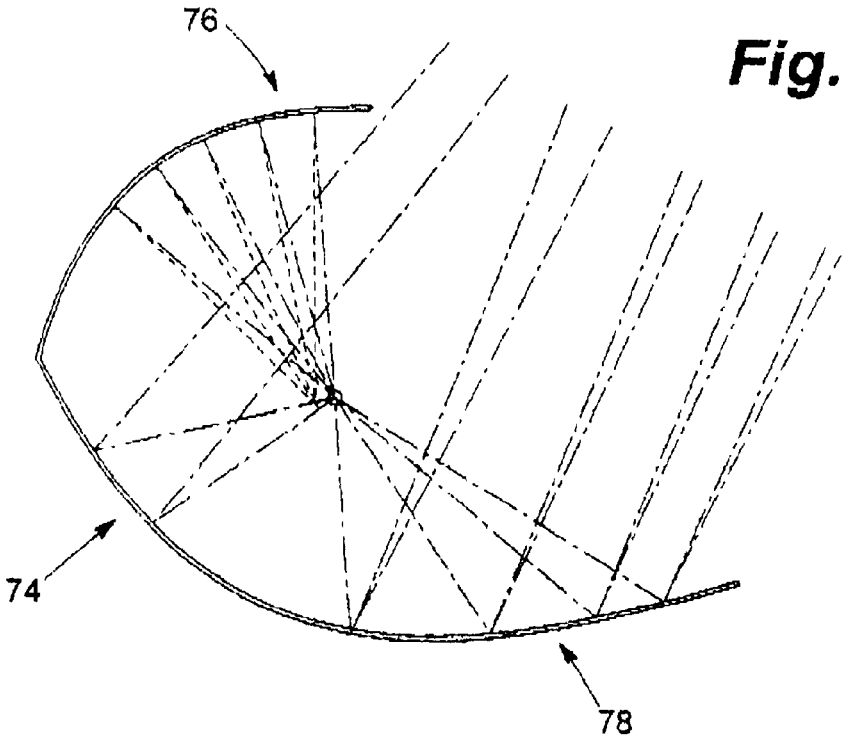
FIG. 6A is a side elevational view of a second embodiment of the primary reflector formed according to the invention and having a smoothly contoured surface.
Figure 6B:
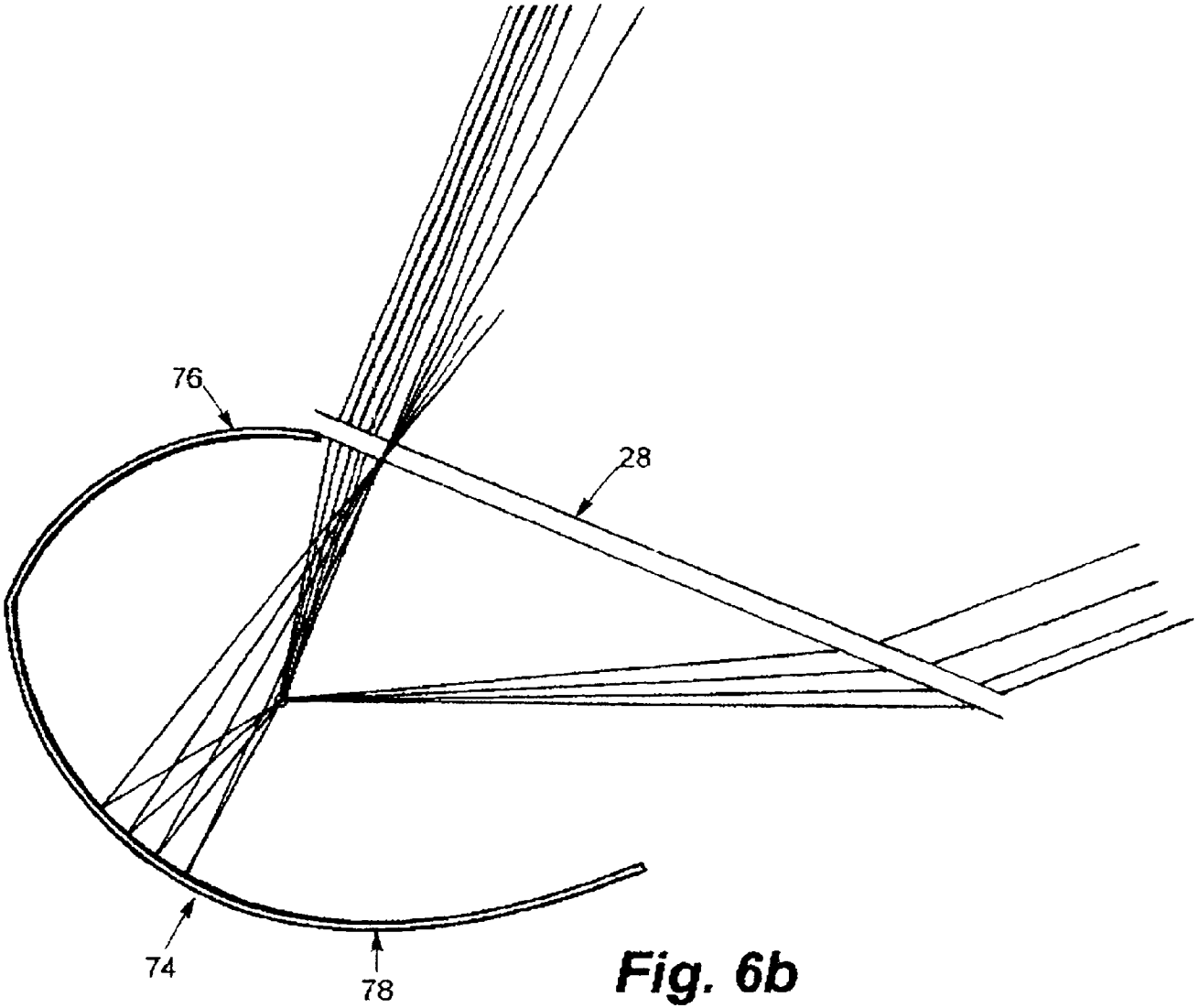
FIG. 6B is a diagrammatical view of the primary reflector of FIG. 6A illustrating reflection of light from the reflector.

Referring now to FIGS. 6A and 6B, a primary reflector configured according to the invention is seen at 74 and is shaped similarly to the reflector 22 described in FIGS. 5A through 5C. However, the reflector 74 is smoothly contoured rather than formed of reflective segments. The reflector 74 also has an upper arcuate portion 76 corresponding to the upper arcuate portion 66 of the reflector 22 and further has a lower arcuate portion 78 corresponding to the lower arcuate portion 68 of the reflector 22. The reflector 74 can be formed without segments such as by hydroforming. The reflector 22 would be preferred in view of the fact that metals referred to herein such as the Alanod Miro materials are not readily capable of being formed by hydroforming processes since thin films present on such materials are susceptible to tearing. Such materials must be formed in a manner whereby stretching does not occur, thereby causing the segmented reflector 22 to be preferred in light of the greater reflective efficiencies of the Miro materials. As is seen in FIG. 6B, the smooth curvilinear conformation of the primary reflector 74 effectively reflects at least certain of the light rays incident thereon and emanating from the lamp 18 to the refractors 26 as aforesaid. It is to be noted from FIG. 6B that some of the light emanating from the lamp 18 is directly incident on the refractors 26.

The terminating edge 70 of the upper arcuate portion 66 of the reflector 22 seen in FIG. 5A inter alia can be extended forwardly of the position shown, a further embodiment of the primary reflector then being provided that would eliminate or reduce the need for refractive structures to be disposed on that portion of the lens 28 surmounting said extended reflector edge (not shown). However, a reflector so formed would not produce the efficiencies of the arrangement shown since light incident on such extended reflective surfaces would be reflected onto other reflective surfaces internally of the luminaire for further reflection either directly onto the sign or through the refractors 26 by redirection, the additional reflective "bounce" or bounces causing losses.

Figure 7A:
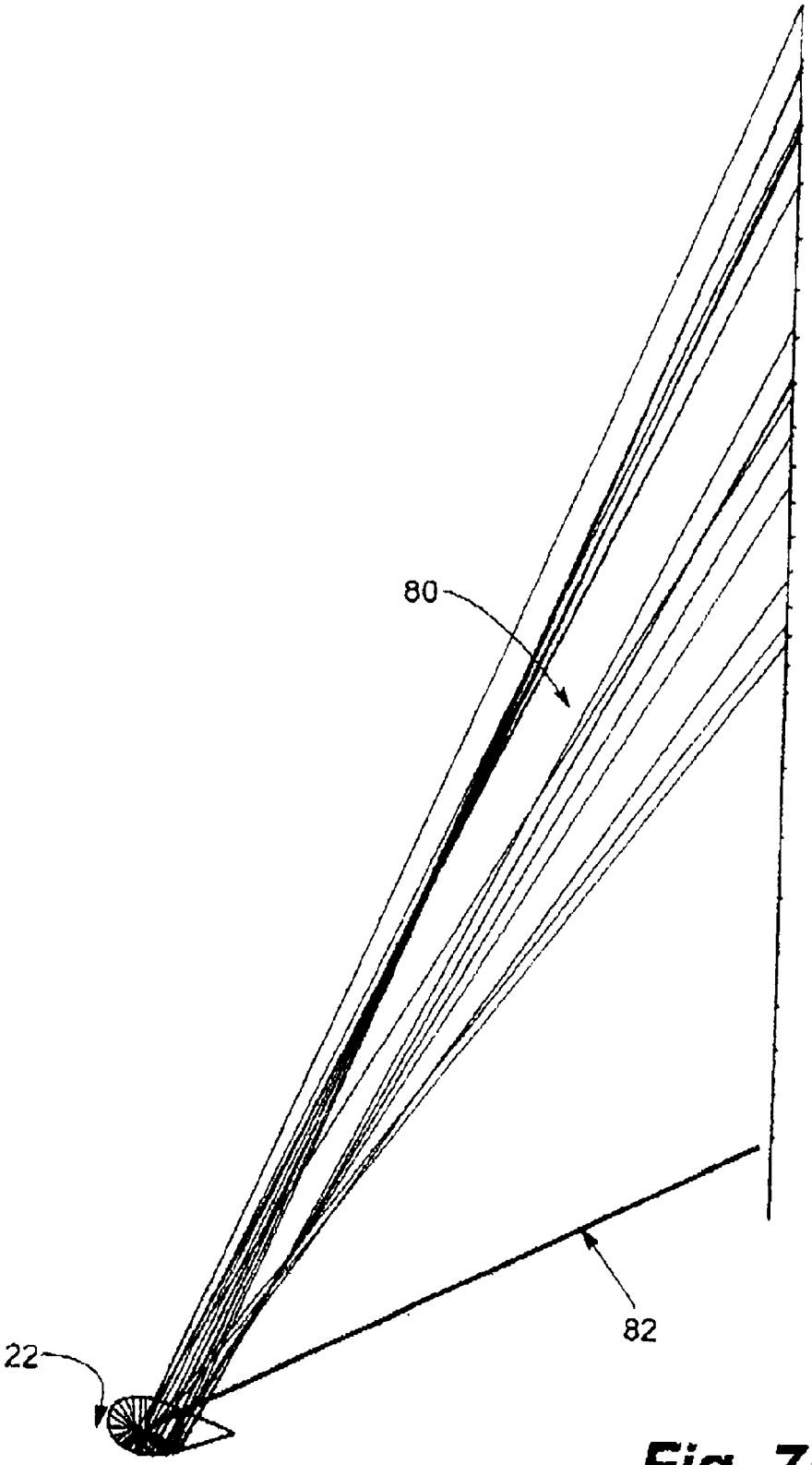
FIG. 7A is a diagrammatical view of a portion of a light pattern directed onto a vertical surface by a reflector and refractor arrangement of the invention.
Figure 7B:
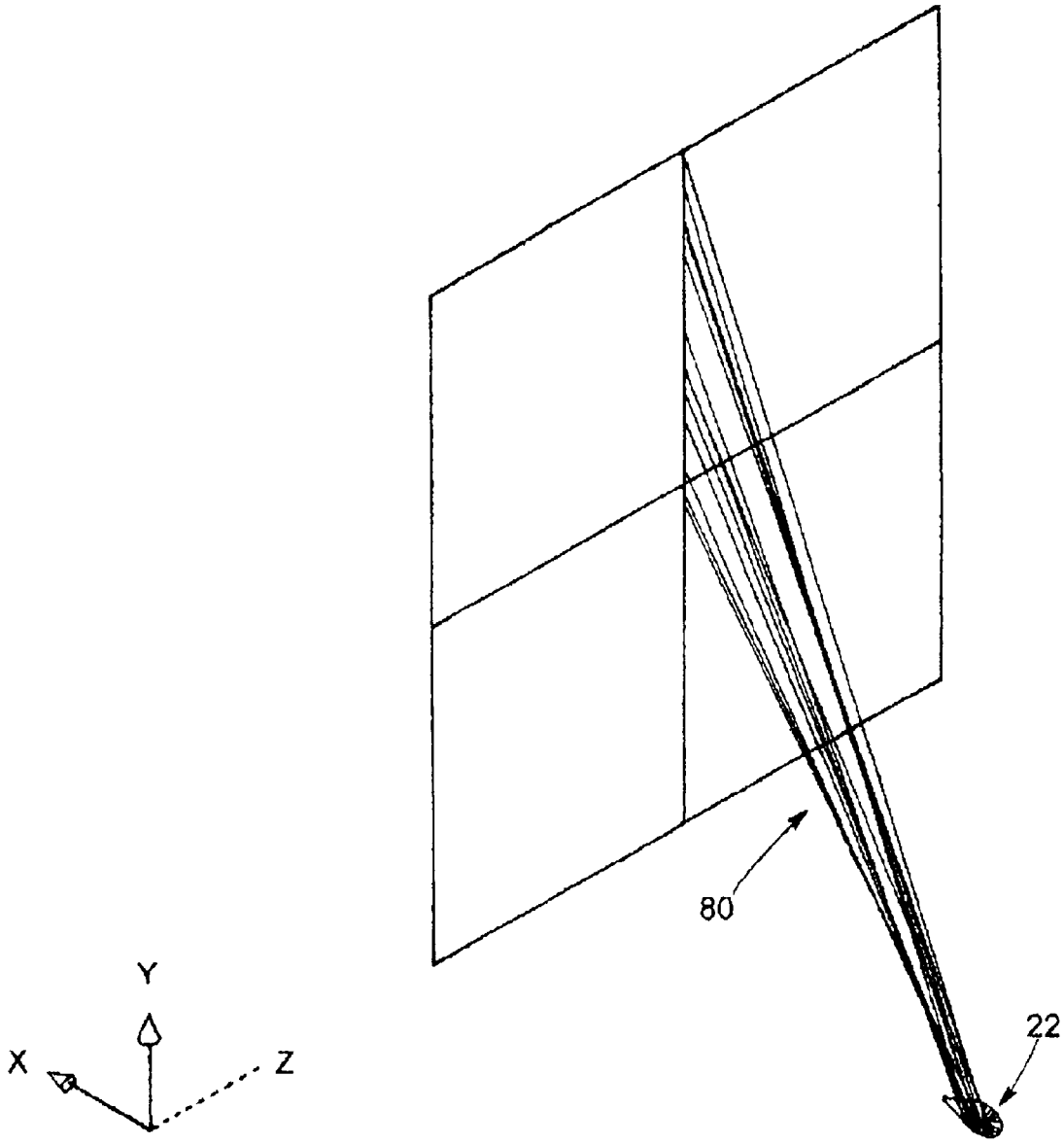
FIG. 7B is a diagrammatical view of another portion of a light pattern directed onto a vertical surface by a reflector and refractor arrangement of the invention.

Referring now to FIGS. 7A and 7B, illustration is provided showing the reflection of light rays from a primary reflector configured according to the invention such as the reflector 22 through the clear central portion 48 of the lens 28 as described hereinabove to top portions of the panel 12. These reflective rays, referred to in FIGS. 7A and 7B at 80 are those rays which pass through the clear central portion 48 of the lens 28 without being redirected by refractive structure such as the refractors 26 (not shown in FIGS. 7A and 7B). Direct rays from the lamp 18 (not shown in FIGS. 7A and 7B) are indicated at 82 in FIG. 7A also pass through the clear central portion 48 of the lens 28 and onto lowermost portions of the panel 12. The direct rays 82 are not reflected from reflective structure contained within the housing 16 (not shown in FIGS. 7A and 7B). It is to be understood that the single line referred to at 82 in FIG. 7A represents multiple rays.

Figure 8:
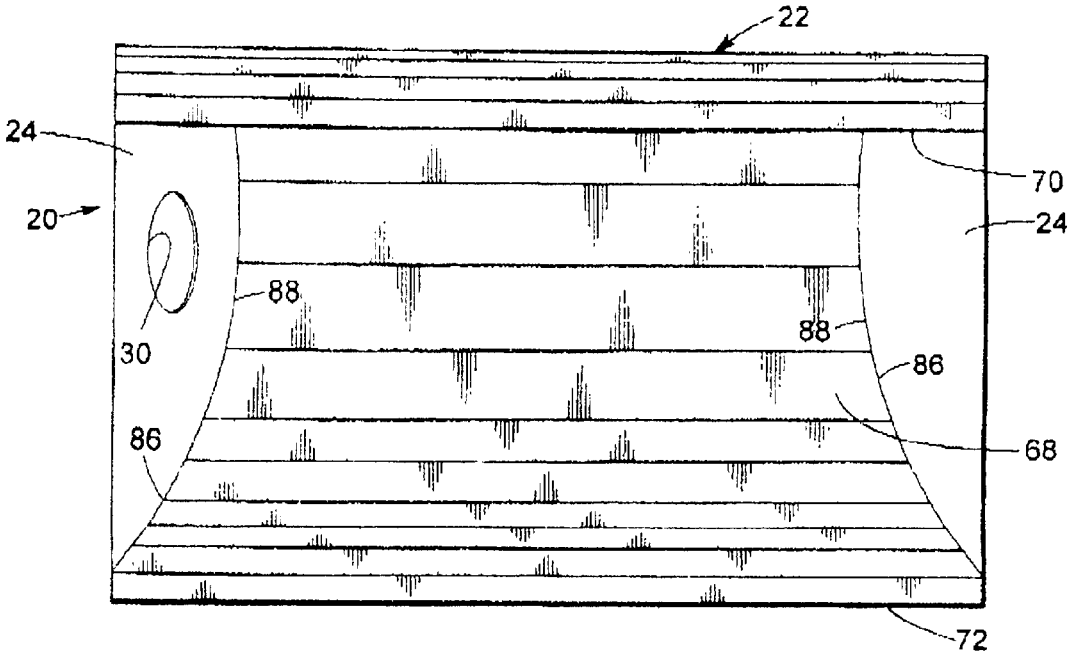
FIG. 8 is a plan view of a reflector assembly formed according to the invention and having a primary reflector and first and second side reflectors associated therewith.

Referring now to FIG. 8, a plan view is provided illustrating the primary reflector 22 in assembly with one each of the side reflectors 24 disposed on opposite lateral sides of the reflector 22, the primary reflector 22 and the side reflectors 24 forming the reflector assembly 20. As is shown in FIG. 8, the opening 30 mentioned above is formed in one of the side reflectors 24, the opening 30 permitting the lamp 18 and the associated socket 32 (not shown in FIG. 8) to be mounted in an operative relationship with the reflector assembly 20, the lamp 18 and socket 32 being mounted within the interior of the housing 16 (not shown in FIG. 8) in a conventional manner. The side reflectors 24 can be mounted to the primary reflector 22 by any convenient mechanical expedient such as the tab and slot arrangement described in FIG. 5 of U.S. Pat. No. 4,261,030, this patent being incorporated hereinto by reference. FIG. 8 also further illustrates a preferred three-dimensional shape of one of the primary reflectors 22 by permitting visualization of scalloped cutouts 86 formed in the primary reflector 22 on lateral sides thereof, the effective width of the primary reflector 22 at terminating edges 70 and 72 being essentially equal to the interior width of the housing 16 (not shown in FIG. 8). The side reflectors 24 of FIG. 8 can be seen to conveniently be formed of flat sheets of reflective material having arcuate edges 88 which are the exact reverse of the arcuate shape of the scalloped cutouts 86 of the reflector 22 so as to mate therealong and be mounted thereto as aforesaid.

Figure 9A:
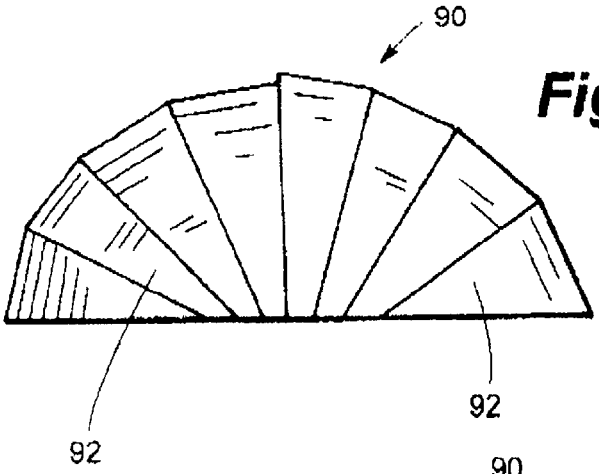
FIGS. 9A, 9B and 9C are front elevational, side elevational and plan views of a faceted side reflector usable in the place of one or both of the side reflectors of FIG. 8.
Figure 9B:
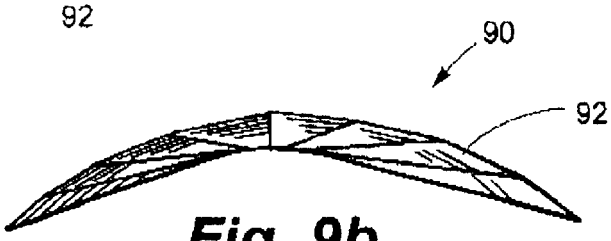
Figure 9C:
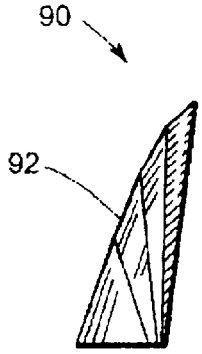
Figure 9D:
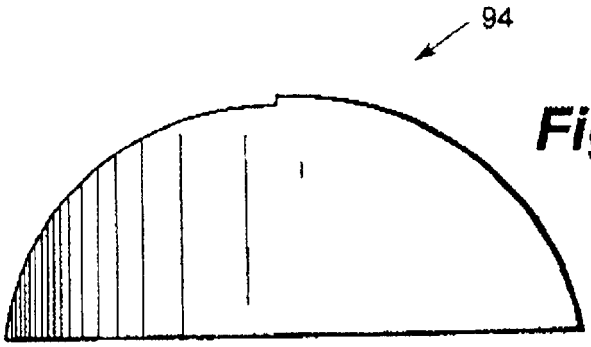
FIGS. 9D, 9E and 9F are front elevational, side elevational and plan views of a curved side reflector usable in the place of one or both of the side reflectors of FIG. 8.
Figure 9E:
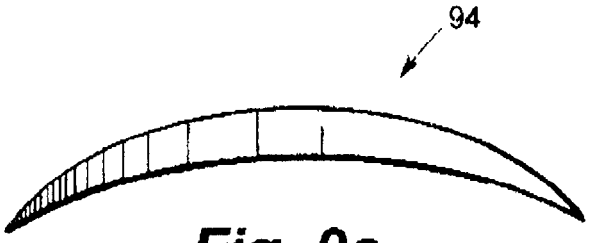
Figure 9F:
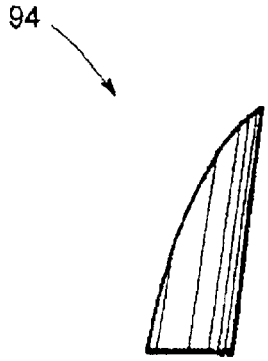

As can be seen in FIGS. 9A through 9F, side reflectors configured according to the invention can be formed other than from planar reflective sheet material. In particular, FIGS. 9A through 9C illustrate a faceted reflector 90 formed from a flat sheet of reflective material and bent to form generally triangular reflective segments 92, these segments 92 essentially comprising facets of the reflector 90. It is to be understood that one of the faceted reflectors 90 can be substituted in the reflector assembly 20 of FIG. 8 for the planar side reflectors 24. It should also be understood that a reflector assembly 20 configured according to the invention can be formed with only one of the side reflectors 24 or faceted reflectors 90. Similarly, FIGS. 9D through 9F illustrate a side reflector seen at 94 which is curved such as in the form of a section of a parabola, such a reflector shape typically being formed by hydroforming techniques. Use of side reflectors such as the curved side reflector 94 can provide greater control of light reflection than is possible with the planar side reflectors 24. Similarly, the faceted reflector 90 of FIGS. 9A through 9C provide similar improvement over planar side reflectors although the side reflectors represented by the faceted reflector 90 and the curved side reflector 94 are more expensive to manufacture. FIGS. 9D through 9F illustrate the curved nature of the side reflector 94, it being understood that the side reflector 94 can be substituted in the reflector assembly 20 of FIG. 8 for the planar side reflectors 24. Alternatively, a combination of any of the reflectors 24, 90 and 94 can be utilized to form a reflector assembly according to the invention. Particular use of side reflectors such as the reflectors 24, 90 and 94 will be described hereinafter relative to FIG. 15.

Side reflectors such as the reflectors 24, 90 and 94 can be mounted relative to primary reflectors such as the primary reflectors 22 and 74 and with relation thereto at angles that can vary according to differences in sign dimensions.

Figure 10:
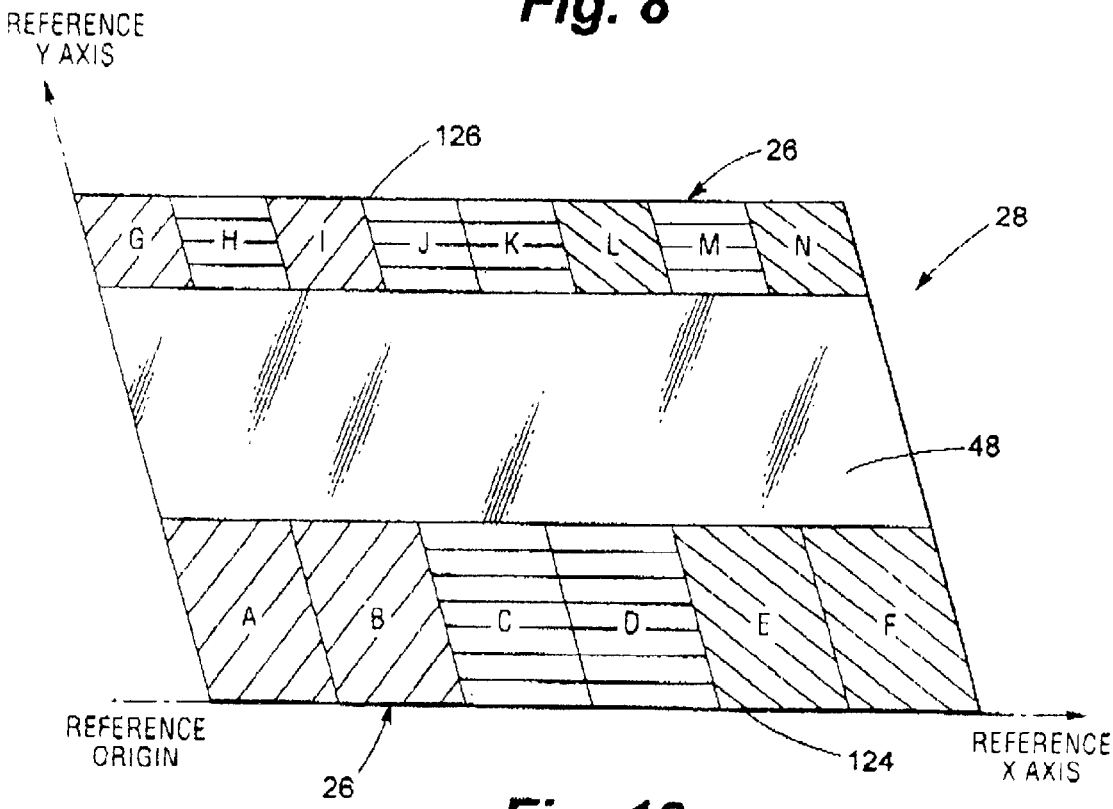
FIG. 10 is a schematic representation of refractive structures formed on a luminaire housing according to the invention and illustrating particular prismatic sections.

Referring now to FIG. 10, a schematic representation of the lens 28 is provided in order to illustrate the type and locations of the refractors 26 formed on said lens 28. A schematic is chosen for illustration in this situation since a schematic provides more information than would a view of an actual lens having refractive elements associated therewith. As is seen in FIG. 10, the refractors 26 disposed along a lowermost and innermost edge of the lens 28 is formed of prismatic sections A through F. As will be further described hereinafter, the prismatic sections A through F differ in order to provide desired redirection of light incident thereon. In a similar manner, the refractor 26 disposed along an upper or outward edge of the lens 28 is formed of prismatic sections G through N. The prismatic sections A through N are formed of prisms such as the prisms 50 referred to hereinabove. The prisms 50 of the prismatic sections A through N refract, transmit and then refract light radiating from the lamp 18 (not shown in FIG. 10) and reflected from the reflector assembly 20 (not shown in FIG. 10) as has been referred to hereinabove and as will be described further hereinafter. In general, the light refracted by the prisms 50 redirect light onto the panel 12 (not shown in FIG. 10) that would otherwise not be incident on the panel 12 and would accordingly become spill light wasted into the surrounds of the panel 12.

In the embodiment of the invention shown in FIG. 10, the prismatic sections A through N are formed along the entire longitudinal edges of the lens 28. Longitudinal edge 124 of the lens 28 is disposed nearmost to the panel 12, second longitudinal edge 126 being disposed further from the panel 12. In the description of the prismatic sections A through N of FIG. 10 and relative also to certain other Figures, reference is made to prism orientation angles oriented with respect to X and Y axes and a reference origin point "zero" as shown in FIG. 10. In FIG. 10, six prismatic sections A through F are disposed along the first longitudinal edge 124 of the lens 28. Prisms of prismatic section A and prismatic section B are oriented as shown at angles in the range of approximately zero to 20° from the reference X axis. Prismatic sections A and B are each sized to be approximately 3 inches in height with a varying width. Prisms of prismatic section C and prismatic section D are oriented at angles approximately 0° from the reference X axis positioned approximately parallel to the first longitudinal axis 124. Prismatic sections C and D are each sized to be approximately 3 inches in height with varying width. Prisms of the prismatic sections E and F are oriented at angles in the range of approximately 160 to 180° from the reference X axis. Prismatic sections E and F are each sized to be approximately 3 inches in height with a varying width. A height of three inches for said prismatic sections is preferable in order to allow redirection of light from the lamp 18 (not shown in FIG. 10) that may otherwise fall below the panel 12 (not shown in FIG. 10) so that said redirected light falls on the panel 12 and without interference with reflected light from an end of the primary reflector 22 and which is traveling in paths incident with the panel 12. The width of each of the prismatic sections A, B, C, D, E and F may vary. However, the total of the width of said sections along the first longitudinal edge 124 is preferably 16 inches in total length of the refractor 26, this length being chosen due to the fact that desirable performance is only achieved with difficulty at openings of less than 16 inches given lamp sizing such as is chosen for the lamp 18 described above.

Referring still to FIG. 10, eight prismatic sections G through N are formed along the second longitudinal edge 126 of the lens 28. Prisms of the prismatic sections G and I are oriented at angles in a range of approximately zero to 20° from the reference X axis. Prismatic sections G and I are each sized to be approximately one inch in height with a varying width. Prisms of the prismatic sections H, J, K and M are oriented at angles of approximately 0° from the reference X axis and are positioned to be approximately parallel to the second longitudinal edge 126. Prismatic sections H, J, K and M are each sized to be approximately one inch in height with varying widths. Prisms of the prismatic sections L and N are oriented to be angled in the range of approximately 160 to 180° from the reference X axis. Prismatic sections L and N are each sized to be approximately one inch in height with varying widths. The widths of each of the prismatic sections H through N can vary. However, the total of the widths of said sections along the second longitudinal edge 126 is preferably approximately sixteen inches in length. The prisms of the prismatic sections C and D disposed along the first longitudinal edge 124 of the lens 28 act to lift light across vertical surfaces of the panel 12 that are to be illuminated. However, the prismatic sections C and D are not necessary for achieving uniformity for many applications and are therefore only optionally provided according to the teachings of the invention. When these sections are not provided, those portions of the lens 28 ordinarily occupied by the prismatic sections C and D can simply be an extension of the clear central portion 48 of said lens 28.

Referring now to FIG. 11, a schematic view of a further embodiment of the invention is provided in order to illustrate a lens 28' usable in place of the lens 28 described hereinabove. Prismatic sections of the lens 28' can be formed of two elongated prismatic sections 128 and 130, the prismatic sections 128 and 130 being respectively disposed along opposing longitudinal edges of the lens 28'. In the prismatic sections 128 and 130, prisms comprising said sections 128, 130 are continuous along longitudinal edges of the lens 28'. Prisms forming the prismatic section 130 are similar in angle to those prisms described in prismatic sections A through F of FIG. 10 with the exception that the prisms of the prismatic section 130 are continuously swept across the lens 28' rather than being segmented. Similarly, prisms of the prismatic section 128 are continuously swept across the lens 28'. The prisms of the prismatic section 130 act to redirect light downwardly onto the panel 12 while prisms of the prismatic section 128 act to redirect or lift light upwardly onto the panel 12.

Referring now to FIG. 12, a further alternative embodiment of a lens similar to the lens 28 is referred to as lens 28", the lens 28" having three prismatic sections referenced as R, P and S. The prisms 70 of the prismatic section R are located along one longitudinal edge of the lens 28", prisms of the prismatic section R being swept smoothly and continuously across the lens 28", the prismatic section R being sized to be approximately one inch in height and approximately sixteen inches in length. Prisms of the prismatic section P are similarly angled as are the prisms of the prismatic sections A through C of FIG. 10 with the exception that the prisms of the prismatic section P are continuously swept from a lateral edge of the lens 28" to a width of approximately five inches. The prismatic section P is spaced approximately one inch from the nearmost longitudinal edge of the lens 28" and is sized to be approximately three inches in height. Similarly, the prisms of the prismatic section S are similarly angled as the prisms of the prismatic sections D through F of FIG. 10 with the exception that the prisms of the prismatic section S are continuously swept from a lateral edge of the lens 28" opposite the location of the prismatic section P and to a width of approximately five inches. The prismatic section S is spaced approximately one inch from the nearmost longitudinal edge of the lens 28" and is sized to be approximately three inches in height. In order to achieve the effect of reducing misdirected spill light, the prisms so described above should preferably have an angle that increases as the prisms advance toward an outermost longitudinal edge of either of the lenses 28, 28' and 28".

Referring now to FIG. 13, a further alternate embodiment usable in place of the lens 28 is referred to as lens 28'". The lens 28'" does not provide a prismatic section along a lowermost longitudinal edge thereof Prismatic section T of the lens 28'" is disposed along the full length of the opposite longitudinal edge of the lens 28'", prisms comprising the prismatic section T being swept smoothly and continuously across the lens 28'". The prismatic section T is sized to be approximately one inch in height and sixteen inches in length.

Referring now to FIG. 14, yet another alternative embodiment of the lens 28 is illustrated and referred to as lens 28"". In this embodiment of the invention, the lens is contoured in three dimensions so as to form a conformation known as a sag glass shape or drop glass shape. The configuration of the lens 28"" allows a luminaire fitted according to the invention with said lens to effectively transmit light reflected from opposite lateral sides of a reflector assembly such as the reflector assembly 20. By virtue of employing the contoured shape of the lens 28"", light passes through the surface of the lens 28"" closer to surfaces normal thereof to thereby increase light throughput while reducing light reflection off inside surfaces of a lens as configured as the planar structures referred to hereinabove. Although the lens 28"" of the embodiment of FIG. 14 is formed of clear glass having no prismatic sections, it will be apparent to those familiar with the art of optical design that such a contoured lens 28"" can be utilized in place of the lens structures referred to hereinabove.

Figure 15:
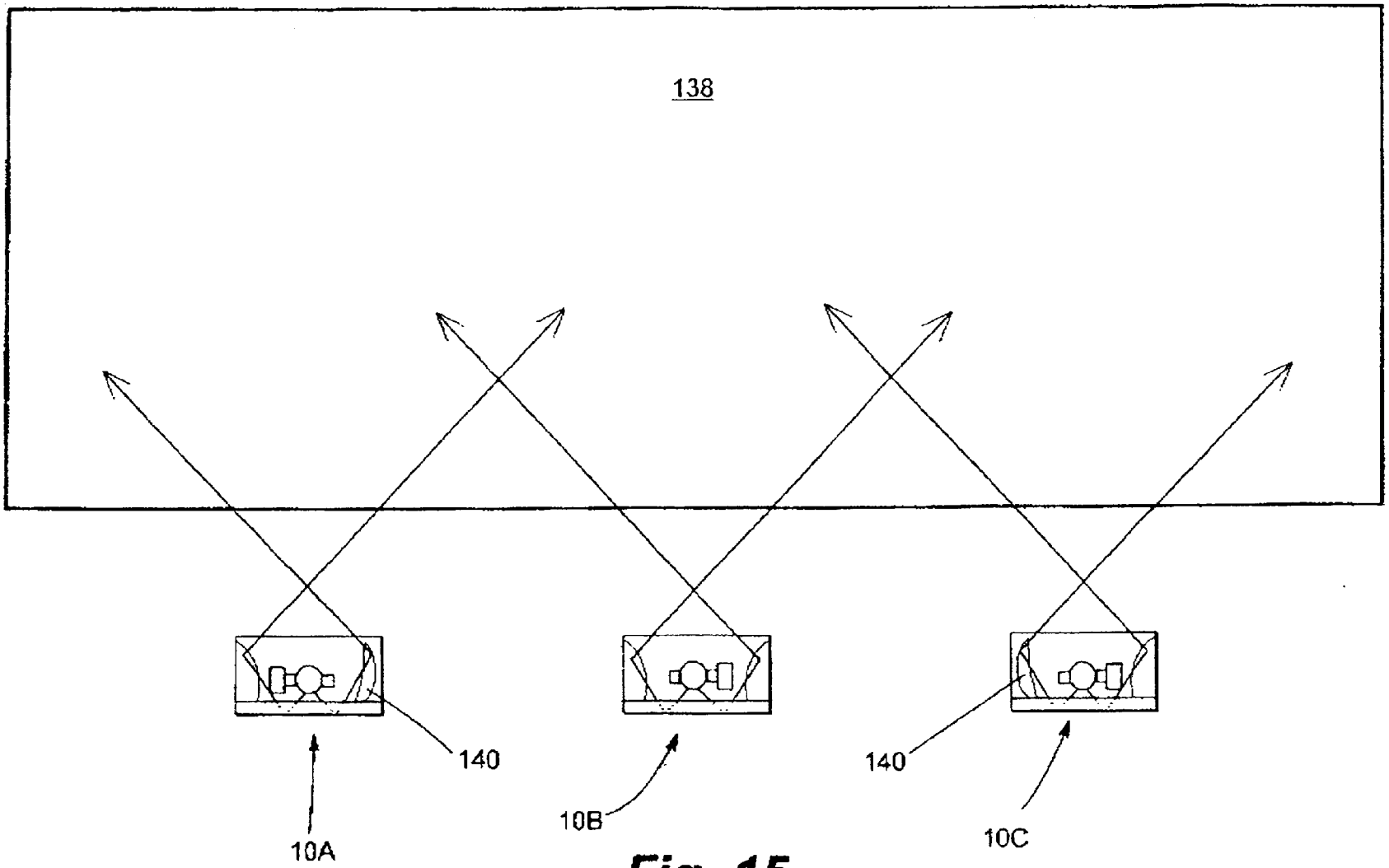
FIG. 15 is a diagram illustrating the use of three luminaires configured according to the invention for illumination of a billboard of standard dimensions.

Referring now to FIG. 15, reference is made to a panel 138 that is similar to the panel 12 described hereinabove, the panel 138 essentially taking the form of a billboard such as is fourteen feet high by forty-eight feet wide. In the prior art, a billboard such as the panel 138 could only be efficiently illuminated through the use of at least four luminaires. The luminaires of the present invention are capable of illuminating a billboard such as the panel 138 with as few as three luminaires, thereby saving the cost of one luminaire while retaining a desirable level of light intensity over a full vertical surface of the panel 138 and with desirable uniformity of illumination. In FIG. 15, three luminaires configured in the manner of the luminaire 10 described above are provided, the luminaires of FIG. 15 being referred to as 10A, 10B and 10C. The luminaires 10A, 10B and 10C are mounted in a conventional manner by means of supports (not shown in FIG. 15) such as are described hereinabove. Each of the luminaires 10A and 10C are spaced from the luminaire 10B at the same distance, the luminaires 10A and 10C also being spaced from respective lateral edges of the panel 138 at essentially the same distance, the distances of the luminaires 10A and 10C from respective lateral edges of the panel 138 being approximately 20 to 25% less than the spacings between the luminaires 10A, 10B and 10C. The center luminaire 10B need not be provided with side reflectors such as the reflectors 24, 90 and 94 since there is no need to control light exiting the luminaire 10B laterally of said luminaire 10B. However, the luminaire 10A is provided with one of the side reflectors 24, 90 or 94 at the side of the luminaire 10A disposed away from the nearmost lateral edge of the panel 138. Similarly, the luminaire 10C is provided with a side reflector such as one of the reflectors 24, 90 and 94 at the edge of the luminaire 10C disposed away from the lateral edge nearmost the luminaire 10C. In other words, side reflectors are provided for the luminaires 10A and 10C only on one side thereof, that is, the sides of the luminaires 10A and 10C located at the greater distance away from nearmost lateral edges of the panel 138. For convenience, side reflectors referenced in FIG. 15 are referred to as side reflectors 140. The three luminaires 10A, 10B and 10C shown in FIG. 15 efficiently and uniformly illuminate the panel 138. Luminaires configured according to the invention can typically be spaced approximately sixteen feet apart. In the prior art, luminaires employing 400 Watt lamps are typically positioned approximately twelve feet apart. In the prior art, lighting situations wherein luminaires fitted with 400 Watt lamps typically required the use of four of such luminaires to illuminate a standard 14'×48' sign. The present invention thereby allows effective lighting of a 14'×48' sign with only three luminaires fitted with 400 Watt lamps. Further, the luminaires of the present invention provide effective lighting of such a standard sign with a lesser amount of energy since only approximately 1.79 lamp watts per square foot of sign is necessary for appropriate illumination rather than the approximately 2.38 lamp watts per square foot of sign typically required for adequate illumination using prior outdoor sign luminaires.

Figure 16:
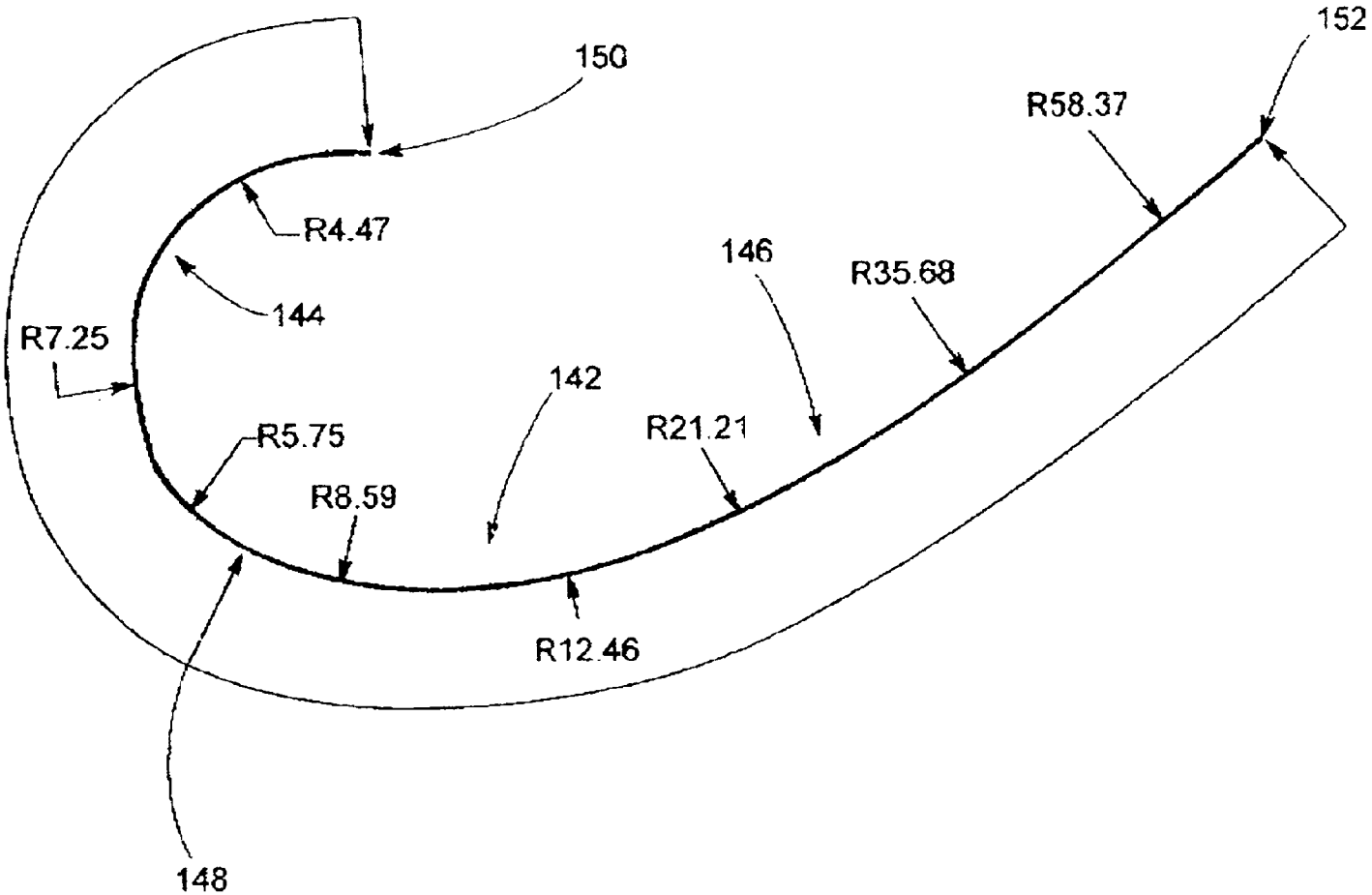
FIG. 16 is a diagram illustrating a primary reflector configured according to the invention whereby portions of a primary reflector are formed of differing material having differing reflective characteristics; and, FIG. 17 is a schematic in side elevation of a luminaire configured according to the invention and having a light source vertically oriented within a luminaire housing.

Referring now to FIG. 16, a primary reflector 142 configured in the manner of the reflector 22 or of the reflector 74 referred to hereinabove illustrates formation of differing portions of such a reflector from reflective metals having differing optical characteristics, such characteristics being either diffuse, semi-diffuse or specular. Metals such as aluminum are manufactured according to processes that provide reflective surfaces on such metals capable of specular reflection, semi diffuse reflection and diffuse reflection. Reference is made to U.S. Pat. No. 4,188,657, incorporated hereinto by reference, for further disclosure of such optical characteristics. Optical characteristics of metals also can be varied by coatings and finishing films as well as other processing in order to provide portions of the primary reflector 142 having desired reflectivity characteristics. The primary reflector 142 is seen to be formed generally in the same cross-sectional shape as are the primary reflectors 22 and 74 described above. Radii indicated by the designations R with dimensions define the particular curvature of the reflector 142. The primary reflector 142 is further formed of top section 144 and bottom section 146. Reflective surfaces of the top section 144, that is, that portion of the reflector 142 lying between that location referred to at 148 and terminating at 150 being formed of a reflective material such as Miro 4, a product of Alanod Aluminum-Veredlung GmbH of the Federal Republic of Germany while that portion of the reflector 142 lying between the location at 148 and terminating at 152 is formed of a Miro 5 material as is also manufactured by Alanod. Choices of materials and/or finishes having differing optical characteristics allow improved lighting control thereby to permit more uniform illumination of an outdoor sign or the like while minimizing light spillage. "Miro" is a trademark of Alanod Aluminum-Veredlung GmbH of the Federal Republic of Germany.

Referring again to FIG. 5A, the upper arcuate portion 66 of the reflector 22 can be formed of or surfaced with a specular material while the lower arcuate portion 68 of the reflector 22 can be formed of or surfaced with an axially diffuse material.

Figure 17:
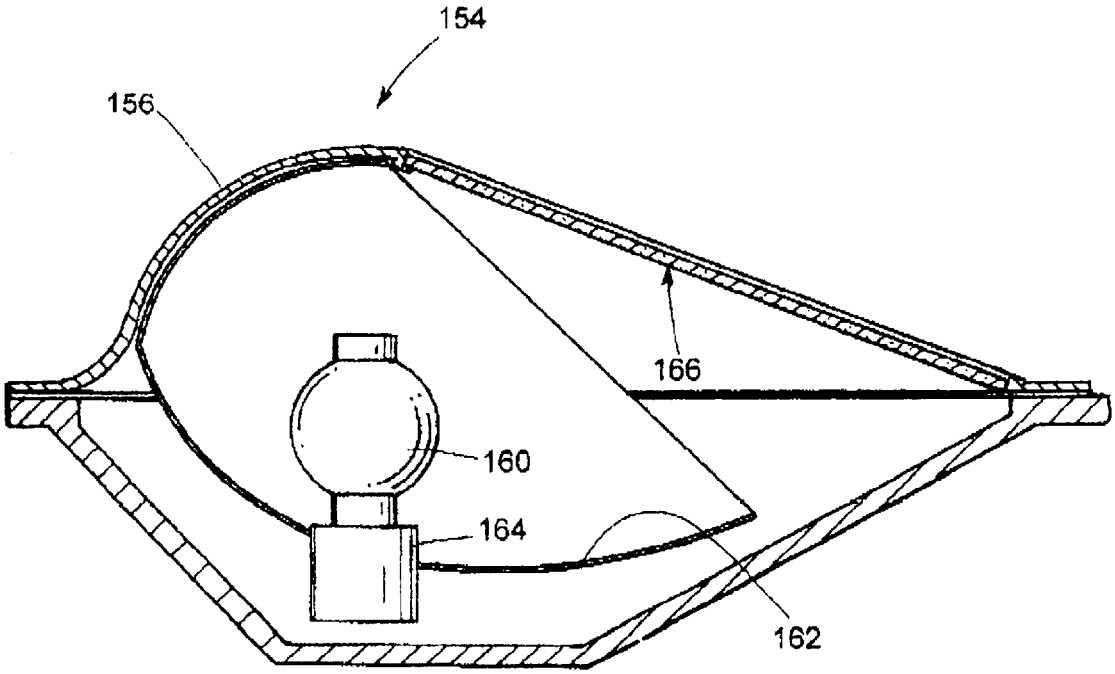

Referring now to FIG. 17, a further embodiment of the invention is shown in a side elevational view in section, the structure illustrated being referred to as luminaire 154 and having a housing 156, an upper portion of which can be essentially identical to the upper cover member 34 of the housing 16 as referred to hereinabove. However, the luminaire 154 is provided with a deeper conformation that permits use of a lamp 160 that is vertically oriented within the luminaire 154. Primary reflector 162 mounted within the housing 156 is provided with an opening (not shown) through which a socket 164 mounting the lamp 160 can extend. The primary reflector 162 can be formed into a reflector assembly by association with side reflectors such as described hereinabove. Similarly, the luminaire 154 is provided with refractive capability by the provision of a lens 166 configured according to any of the several embodiments referred to hereinabove.

Although the invention has been explicitly described herein relative to several embodiments therof, it is to be understood that the particular embodiments shown and described herein are illustrative of the invention and not limiting thereof. Accordingly, the scope of the invention is defined by the recitations of the appended claims.

What is claimed is:

1. A lighting fixture adapted to illuminate a panel, comprising:

a lamp housing;

a lamp disposed within the lamp housing;

a reflector movably affixed to the lamp housing, the reflector having a first curvilinear surface for directing light to the panel; and, a refractor affixed to the lamp housing, the refractor refocusing direct light from the lamp and reflected light from the reflector thereby resulting in increased uniformity of light incident on the panel and reducing the amount of light which misses the panel, the refractor having a first longitudinal edge, a second longitudinal edge and a plurality of prisms to refocus direct light from the lamp and the reflector to increase uniformity of panel illumination and to reduce spill light, the prisms being formed along the first longitudinal edge and the second longitudinal edge of the refractor.

2. The lighting fixture of claim 1 wherein the first curvilinear surface of the reflector includes a plurality of sections formed therein.

3. The lighting fixture of claim 1 and further comprising a first side panel reflector insert and a second side panel reflector insert affixed on the reflector, the first side panel reflector insert being disposed along the longitudinal edge of the reflector, the second side panel reflector insert being disposed along the opposite longitudinal edge of the reflector, the first side panel reflector insert and the second panel reflector insert tailoring the direction of light from the lamp to the panel.

4. The lighting fixture of claim 1 and further comprising a bracket affixed to the lamp housing and engaged for guiding the position of the reflector relative to the housing.

5. The lighting fixture of claim 1 and further comprising at least one optical insert affixed to the reflector for increasing light incident on the panel and decreasing the amount of spill light.

6. The lighting fixture of claim 1 wherein the refractor is comprised of glass or acrylic.

7. The lighting fixture of claim 1 wherein the refractor includes internal prisms that control light from the lamp.

8. The lighting fixture of claim 1 wherein the reflector is comprising of aluminum.

9. The lighting fixture of claim 1 wherein the reflector is comprised of metals which maintain a high average of panel illumination.

10. The lighting fixture of claim 1 wherein the angle of at least certain of the prisms is zero at the center of the refractor and which increase to a maximum angle in the range of 20 to 40 degrees.

11. A lighting fixture adapted to illuminate a panel, comprising:

a lamp housing;

a lamp disposed within the lamp housing;

a reflector movably affixed to the lamp housing, the reflector having a first curvilinear surface for directing light to the panel; and, a refractor affixed to the lamp housing, the refractor refocusing direct light from the lamp and a reflected light from the reflector thereby resulting in increased uniformity of light incident on the panel and reducing the amount of light which misses the panel the refractor having a first longitudinal edge, a second longitudinal edge, and a plurality of prisms for refocusing direct light from the lamp and the reflector to increase uniformity of panel illumination and to reduce spill light, the angle of at least certain of the prisms being zero at the center of the refractor and increasing to a maximum angle in a range of 20 to 40 degrees.

12. A lighting fixture for mounting in front of a panel for illuminating the panel, comprising:

a lamp housing;

a lamp disposed within the lamp housing;

a reflector movably affixed to the lamp housing, the reflector having a first curvilinear surface for directing light to the panel and for producing a uniform horizontal distribution of light on the panel, and, a refractor comprising a first longitudinal edge, a second longitudinal edge, and prisms for refocusing direct light from the lamp and reflected light from the reflector to thereby increase uniformity of panel illumination and to reduce spill light, the prisms being formed along the first longitudinal edge and the second longitudinal edge of the refractor.

13. The lighting fixture of claim 12 wherein the first curvilinear surface of the reflector further includes a plurality of sections formed therein.

14. The lighting fixture of claim 13 wherein the plurality of sections formed in the reflector are segmented.

15. The lighting fixture of claim 12 wherein the refractor further comprises prisms for refocusing direct light from the lamp and reflected light from the reflector to thereby increase uniformity of panel illumination and to reduce spill light.

16. The lighting fixture of claim 12 wherein the angle of at least certain of the prisms is zero at the center of the refractor and increase to a maximum angle in a range of 20 degrees to 40 degrees.

17. The lighting fixture of claim 12 wherein the refractor is formed of glass or acrylic.

18. The lighting fixture of claim 12 wherein the refractor comprises internal prisms for controlling light from the lamp.

19. The lighting fixture of claim 12 wherein the reflector is comprised of aluminum.

20. The lighting fixture of claim 12 wherein the lighting fixture is disposed within a lighting system which evenly and efficiently illuminates a panel, each lighting fixture illuminating an approximately 16-foot horizontal section of the panel, the reflector of each of the lighting fixtures having a first curvilinear surface for directing light to the panel, the refractor of each lighting fixture refocusing light from the lamp and from the reflector to increase uniformity of light across said approximately 16-foot section of the panel, thereby reducing the number of fixtures required to illuminate the panel.

21. The lighting fixture of claim 20 wherein the refractor includes at least one section of prisms distributing light across the approximately 16-foot horizontal section of the panel.

22. The lighting fixture of claim 20 wherein the refractor is contoured in three dimensions to distribute light across the approximately 16-foot horizontal section of the panel.

23. The lighting fixture of claim 20 wherein the reflector comprises a plurality of fluted sections, the plurality of fluted sections distributing light across the approximately 16-foot horizontal section of the panel.

24. A lighting fixture for mounting in front of a panel for illuminating the panel, comprising:

a lamp housing;

a lamp disposed within the lamp housing;

a reflector movably affixed to the lamp housing, the reflector having a first curvilinear surface for directing light to the panel and for producing a uniform horizontal distribution of light;

a first side panel reflector insert affixed to the reflector for directing light from the lamp to the panel;

a second side panel reflector insert affixed to the reflector for directing light from the lamp to the panel; and, a refractor affixed to the lamp housing, the refractor with refocusing direct light from the lamp and reflected light from the reflector, the first side panel reflector insert and the second side panel reflector insert to the panel, the refractor comprising a first longitudinal edge, a second longitudinal edge and prisms for refocusing direct light from the lamp and reflected light from the reflectors to increase uniformity of panel illumination and to reduce spill light, the angle of at least certain of the prisms being zero at the center of the refractor and increasing to a maximum angle in a range of 20 degrees to 40 degrees.

25. A luminaire capable of illuminating a vertical surface, comprising:

a housing;

a lamp mounted within the housing; and, a reflector mounted within the housing for reflecting light from the lamp and incident on the reflector either directly to the surface or to other portions of the luminaire, the lamp being positioned between the reflector and the surface to be illuminated, the reflector being curvilinear in conformation and continuously extending from a location above the lamp and about the lamp in spaced relation thereto to a location below and forwardly of the lamp, the reflector being formed of a first portion extending from the location above the lamp to a location behind said lamp, a second portion of the reflector extending from said location behind the lamp to a location below and forwardly of the lamp, the first and second portions of the reflector being bent at the intersection therebetween into an angular relation relative to each other.

26. The luminaire of claim 25 wherein the reflector is formed of lateral segments comprising reflective facets.

27. The luminaire of claim 25 wherein each portion forms a smoothly continuous curve.

28. The luminaire of claim 25 and further comprising refractor means carried by the housing for redirecting light incident thereon directly from the lamp or reflected by the reflector to the vertical surface.

29. The luminaire of claim 25 wherein at least one side reflector is mounted within the housing to the reflector.

30. The luminaire of claim 29 wherein the side reflector is formed of a planar reflective sheet.

31. The luminaire of claim 29 wherein the side reflector is formed of arcuately formed reflective material.

32. The luminaire of claim 29 wherein the side reflector is formed of reflective facets having reflective surfaces disposed out of plane relative to each other.

33. The luminaire of claim 25 wherein the first and second portions of the reflector are formed of reflective material having differing optical characteristics.

34. The luminaire of claim 25 wherein the lamp is horizontally oriented within the housing.

35. The luminaire of claim 25 and further comprising means carried by the housing for mounting the reflector for movement within the housing.

36. The luminaire of claim 35 wherein the reflector is formed with a slot and the mounting means comprise a boss formed on a floor of the housing and beneath the reflector, the boss having a lumen, the mounting means further comprising an attachment element extendible through the slot and being capable of being received within the lumen of the boss to permit movement of the reflector relative to the boss about the attachment element, and means for tightening the attachment element against the reflector to thereby hold the reflector in a desired orientation within the housing.

37. A luminaire capable of illuminating a vertical surface, comprising:

a housing;

a lamp mounted within the housing; and, a reflector mounted within the housing for reflecting light from the lamp and incident on the reflector either directly to the surface or to other portions of the luminaire, the lamp being positioned between the reflector and the surface to be illuminated, the reflector being curvilinear in conformation and continuously extending from a location above the lamp and about the lamp in spaced relation thereto to a location below and forwardly of the lamp, respective portions of the reflector being formed of reflective material having differing optical characteristics.

38. The luminaire of claim 37 wherein the reflector is formed of a first portion extending from the location above the lamp to a location behind said lamp, a second portion of the reflector extending from said location behind the lamp to the location below and forwardly of the lamp, the first and second portions of the reflector being bent at the intersection therebetween into an angular relation relative to each other.

39. The luminaire of claim 26 wherein the reflector is formed of lateral segments comprising reflective facets.

40. The luminaire of claim 26 wherein each portion forms a smoothly continuous curve.

41. The luminaire of claim 37 and further comprising refractor means carried by the housing for redirecting light incident thereon directly from the lamp or reflected by the reflector to the vertical surface.

42. The luminaire of claim 37 wherein at least one side reflector is mounted within the housing to the reflector.

43. The luminaire of claim 42 wherein the side reflector is formed of a planar reflective sheet.

44. The luminaire of claim 42 wherein the side reflector is formed of arcuately formed reflective material.

45. The luminaire of claim 42 wherein the side reflector is formed of reflective facets having reflective surfaces disposed out of plane relative to each other.

46. The luminaire of claim 37 wherein the lamp is horizontally oriented within the housing.

* * * * *